US010508250B2

(12) United States Patent
Nicolay et al.

(10) Patent No.: US 10,508,250 B2
(45) **Date of Patent: *Dec. 17, 2019**

(54) COMPOSITIONS OF THERMOASSOCIATIVE ADDITIVES WITH CONTROLLED ASSOCIATION AND LUBRICANT COMPOSITIONS CONTAINING THEM

(71) Applicants: TOTAL MARKETING SERVICES, Puteaux (FR); ECOLE SUPERIEURE DE PHYSIQUE ET DE CHIMIE INDUSTRIELLES DE LA VILLE DE PARIS (ESPCI), Paris (FR); CENTRE NATIONAL DE LA RECHERCHE SCIENTIFIQUE(CNRS), Paris (FR)

(72) Inventors: Renaud Nicolay, Verrières-le-Buisson (FR); Thi Hang Nga Nguyen, Le Kremlin Bicêtre (FR); Raphaele Iovine, Mornant (FR); Gregory Descroix, Brindas (FR)

(73) Assignees: Centre National de la Recherche Scientifique (CNRS), Paris (FR); Total Marketing Services, Puteaux (FR); Ecole Superieure de Physique et de Chimie Industrielles de la Ville de Paris (ESPCI), Paris (FR)

( * ) Notice: Subject to any disclaimer, the term of this patent is extended or adjusted under 35 U.S.C. 154(b) by 181 days.

This patent is subject to a terminal disclaimer.

(21) Appl. No.: 15/543,100

(22) PCT Filed: Jan. 11, 2016

(86) PCT No.: PCT/EP2016/050400

§ 371 (c)(1),
(2) Date: Jul. 12, 2017

(87) PCT Pub. No.: WO2016/113229

PCT Pub. Date: Jul. 21, 2016

(65) Prior Publication Data

US 2018/0023028 A1 Jan. 25, 2018

(30) Foreign Application Priority Data

Jan. 15, 2015 (FR) ..... 15 50328

(51) Int. Cl.
*C10M 155/04* (2006.01)
*C10M 169/04* (2006.01)
(Continued)

(52) U.S. Cl.
CPC ..... *C10M 169/044* (2013.01); *C10M 105/00* (2013.01); *C10M 129/08* (2013.01);
(Continued)

(58) Field of Classification Search
CPC ..... C10M 155/04; C10M 169/044
See application file for complete search history.

(56) References Cited

U.S. PATENT DOCUMENTS 4,401,797 A 8/1983 Gallop
5,370,807 A 12/1994 Gambini et al.
(Continued)

FOREIGN PATENT DOCUMENTS

FR 2855180 A1 11/2004
WO WO-2013/147795 A1 10/2013

*Primary Examiner* — Ellen M McAvoy
(74) *Attorney, Agent, or Firm* — Harness, Dickey & Pierce, PLC

(57) ABSTRACT

The present disclosure relates to novel compositions of additives that result from mixing at least two thermoassociative and exchangeable copolymers and at least one compound for controlling the association of these two copolymers. A lubricant composition results from mixing at least one lubricating base oil, at least two thermoassociative and exchangeable copolymers and at least one compound for
(Continued)

controlling the association of these two copolymers. The present disclosure also relates to a process for modulating the viscosity of a lubricant composition that results from mixing at least one lubricating base oil, at least two thermoassociative and exchangeable copolymers; as well as the use of a diol compound for modulating the viscosity of a lubricant composition.

19 Claims, 5 Drawing Sheets

(51) Int. Cl.
*C10M 161/00* (2006.01)
*C10M 105/00* (2006.01)
*C10M 129/08* (2006.01)

(52) U.S. Cl.
CPC ..... *C10M 155/04* (2013.01); *C10M 161/00* (2013.01); *C10M 2203/003* (2013.01); *C10M 2203/1025* (2013.01); *C10M 2205/04* (2013.01); *C10M 2207/022* (2013.01); *C10M 2209/04* (2013.01); *C10M 2209/084* (2013.01); *C10M 2217/024* (2013.01); *C10M 2221/02* (2013.01); *C10M 2229/00* (2013.01); *C10N 2230/02* (2013.01); *C10N 2230/68* (2013.01); *C10N 2270/02* (2013.01)

(56) References Cited

U.S. PATENT DOCUMENTS

| | | | | |
|---|---|---|---|---|
| 9,120,076 | B2 | 9/2015 | Matray et al. | |
| 9,493,722 | B2 | 11/2016 | Doyen et al. | |
| 10,005,900 | B2 * | 6/2018 | Leibler | C08F 210/02 |
| 10,011,711 | B2 * | 7/2018 | Leibler | C08F 210/02 |
| 2015/0075789 | A1 | 3/2015 | Singh et al. | |
| 2017/0008989 | A1 | 1/2017 | Nguyen et al. | |
| 2017/0009176 | A1 | 1/2017 | Nguyen et al. | |

* cited by examiner

COMPOSITIONS OF THERMOASSOCIATIVE ADDITIVES WITH CONTROLLED ASSOCIATION AND LUBRICANT COMPOSITIONS CONTAINING THEM

CROSS-REFERENCE TO RELATED APPLICATIONS

This application is a National Phase Entry of International Patent Application No. PCT/EP2016/050400, filed on Jan. 11, 2016, which claims priority to French Patent Application Serial No. 1550328, filed on Jan. 15, 2015, both of which are incorporated by reference herein.

TECHNICAL FIELD

The present invention relates to novel compositions of additives that result from mixing at least two thermoassociative and exchangeable copolymers and at least one compound for controlling the association of these two copolymers. The invention also relates to a lubricant composition that results from mixing at least one lubricating base oil, at least two thermoassociative and exchangeable copolymers and at least one compound for controlling the association of these two copolymers. The present invention also relates to a process for modulating the viscosity of a lubricant composition that results from mixing at least one lubricating base oil, at least two thermoassociative and exchangeable copolymers; as well as the use of a diol compound for modulating the viscosity of a lubricant composition.

BACKGROUND AND SUMMARY

High molecular weight polymers are widely used for increasing the viscosity of solutions in many fields, such as the oil industry, papermaking industry, water treatment industry, mining industry, cosmetics industry, textile industry and generally in all industrial techniques using thickened solutions. Now, these high molecular weight polymers have the drawback of low resistance to permanent shear compared to the same polymers of smaller size. These shearing stresses acting on high molecular weight polymers lead to cleavage in the macromolecular chains. Thus degraded, the polymer has diminished thickening properties, and the viscosity of the solutions containing it decreases irreversibly. Moreover, these polymers do not allow modulation of the thickening of the composition to which they are added as a function of the temperature of use of the composition.

The applicant's objective was to formulate novel compositions of additives that have better shear resistance compared to the compounds of the prior art, and the rheological behaviour of which can be adapted as a function of the use of the composition to which these additives are added. This objective is achieved by combining associative, thermoreversibly exchangeable additives and an agent for controlling the association and dissociation of these additives. The associated (potentially cross-linked) and exchangeable copolymers offer the advantage of being more resistant to shearing stresses. This characteristic results from the combined use of two particular compounds, a random copolymer bearing diol functions and a compound comprising at least two boronic ester functions.

Polymers in which at least one monomer comprises boronic ester functions are known from document WO2013147795. These polymers are used in the manufacture of electronic equipment, in particular for equipment for which a flexible user interface is required. These polymers are also used as synthesis intermediates. They make it possible to functionalize polymers by coupling with luminescent groups, electron transporting groups, etc. Coupling of these groups is achieved by standard reactions of organic chemistry involving boron atoms, such as for example Suzuki coupling. However, no other use of these polymers, or association with other compounds, is envisaged.

The composition of additives according to the invention offers many advantages. It makes it possible to increase the viscosity of solutions, in particular of hydrophobic solutions comprising them, relative to the compositions of additives of the prior art. The additives of the composition of the invention have inverse behaviour with respect to temperature change compared to the behaviour of the solution and of the rheology additives of the polymer type of the prior art. It also makes it possible to adapt the increase in viscosity and the rheological behaviour of these solutions as a function of their temperature of use.

The applicant also had the objective of formulating novel lubricant compositions which make it possible to reduce the friction between two mechanical components when used cold and when used hot. The compositions used for lubricating mechanical components generally consist of a base oil and additives. The base oil, in particular of petroleum or synthetic origin, exhibits variations in viscosity when the temperature is varied.

In fact, when the temperature of a base oil increases, its viscosity decreases, and when the temperature of the base oil decreases, its viscosity increases. Now, the thickness of the protective film is proportional to the viscosity, and therefore also depends on the temperature. A composition has good lubricating properties if the thickness of the protective film remains approximately constant regardless of the conditions and duration of use of the lubricant.

In an internal-combustion engine, a lubricant composition can be subjected to external or internal temperature changes. The external temperature changes are due to the temperature variations of the ambient air, such as the temperature variations between summer and winter, for example. The internal temperature changes result from operating the engine. The temperature of an engine is lower when starting, in particular in cold weather, than during prolonged use. A lubricant composition that is too viscous at the starting temperature can have an adverse effect on the movement of the moving parts and thus prevent the engine turning quickly enough. A lubricant composition must on the one hand also be sufficiently fluid to be able to reach the bearings quickly and prevent wear of the latter, and on the other hand thick enough to ensure good protection of the engine when it reaches its operating temperature. There is therefore a need for a lubricant composition having good lubrication properties both for the phases of engine starting and for the phases of operation of the engine at its operating temperature.

Addition of additives that improve the viscosity of a lubricant composition is known. The additives that improve viscosity (or viscosity index improvers) currently used are polymers such as the polyalphaolefins, the polymethylmethacrylates, and the copolymers resulting from the polymerization of an ethylene monomer and an alpha-olefin. These polymers are of high molecular weight. In general, the contribution that these polymers make to the control of viscosity is greater the higher their molecular weight.

However, the high molecular weight polymers have the drawback of low resistance to permanent shear compared to polymers of the same nature but of smaller size. Moreover, they thicken the lubricant compositions regardless of the service temperature of the lubricant composition, and in particular at low temperature. The lubricant compositions of the prior art comprising viscosity improvers can exhibit poor lubrication properties during the phases of engine starting.

The lubricant composition according to the invention makes it possible to overcome the aforementioned drawbacks through the combined use of a mixture of two thermoassociative and exchangeable compounds (a copolymer bearing diol functions and a compound comprising boronic ester functions) and of a diol compound in a lubricating base oil. Unexpectedly, the applicant observed that addition of a diol compound made it possible to control the association between a copolymer bearing diol functions and a compound comprising boronic ester functions. At low temperature, the polydiol copolymer has little or no association with the compounds comprising boronic ester functions; the latter reacting with the diol compound added. When the temperature increases, the diol functions of the copolymer react with the boronic ester functions of the compound comprising them by a reaction of transesterification. The polydiol random copolymers and the compounds comprising boronic ester functions then bind together and can undergo exchange. Depending on the functionality of the polydiols and of the compounds comprising boronic ester functions, and depending on the composition of the mixtures, a gel can form in the base oil. When the temperature decreases again, the boronic ester bonds between the polydiol random copolymers and the compounds comprising them are ruptured; if applicable the composition loses its gelled character. The boronic ester functions of the compound comprising them react with the diol compound that is added. It is possible to modulate the kinetics and the temperature window of formation of these associations, and therefore modulate the rheological behaviour of the lubricant composition as a function of the desired use. It is possible, by means of the compositions of the invention, to supply lubricant compositions that have good lubrication properties during the phases of engine starting (cold phase) and good lubrication properties when the engine is at its operating temperature (hot phase).

Thus, a subject of the invention is a composition of additives resulting from mixing at least:

- a polydiol random copolymer A1,
- a random copolymer A2 comprising at least two boronic ester functions and able to associate with said polydiol random copolymer A1 by at least one transesterification reaction,
- an exogenous compound A4 selected from the 1,2-diols and the 1,3-diols.

According to an embodiment of the invention, the molar percentage of exogenous compound A4 in the composition of additives, relative to the boronic ester functions of the random copolymer A2 ranges from 0.025 to 5000%, preferably ranges from 0.1% to 1000%, even more preferably from 0.5% to 500%, even more preferably from 1% to 150%.

According to an embodiment of the invention, the random copolymer A1 results from the copolymerization:

of at least one first monomer M1 of general formula (I):

(I)

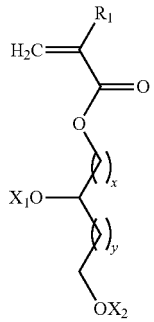

in which:

$R_1$ is selected from the group formed by —H, —$CH_3$, and —$CH_2$—$CH_3$;

x is an integer in the range from 1 to 18; preferably from 2 to 18;

y is an integer equal to 0 or 1;

$X_1$ and $X_2$, which can be identical or different, are selected from the group formed by hydrogen, tetrahydropyranyl, methyloxymethyl, tert-butyl, benzyl, trimethylsilyl and t-butyl dimethylsilyl;

or $X_1$ and $X_2$ form, with the oxygen atoms, a bridge of the following formula

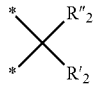

in which:

the stars (*) represent the bonds to the oxygen atoms, $R'_2$ and $R''_2$, identical or different, are selected from the group formed by hydrogen and a $C_1$-$C_{11}$ alkyl, preferably methyl;

or $X_1$ and $X_2$ form, with the oxygen atoms, a boronic ester of the following formula:

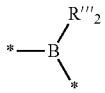

in which:

the stars (*) represent the bonds to the oxygen atoms, $R'''_2$ is selected from the group formed by a $C_6$-$C_{18}$ aryl, a $C_7$-$C_{18}$ aralkyl and $C_2$-$C_{18}$ alkyl, preferably a $C_6$-$C_{18}$ aryl;

with at least one second monomer M2 of general formula (II):

(II)

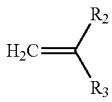

in which:

$R_2$ is selected from the group formed by —H, —$CH_3$ and —$CH_2$—$CH_3$, $R_3$ is selected from the group formed by a $C_6$-$C_{18}$ aryl, a $C_6$-$C_{18}$ aryl substituted with an $R'_3$ group, —C(O)—O—$R'_3$; —O—$R'_3$, —S—$R'_3$ and —C(O)—N(H)—$R'_3$ with $R'_3$ a $C_1$-$C_{30}$ alkyl group.

According to an embodiment of the invention, the random copolymer A1 results from the copolymerization of at least one monomer M1 with at least two monomers M2 having different $R_3$ groups.

According to an embodiment of the invention, one of the monomers M2 of the random copolymer A1 has the general formula (II-A):

(II-A)

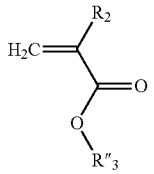

in which:

$R_2$ is selected from the group formed by —H, —$CH_3$ and —$CH_2$—$CH_3$, $R''_3$ is a $C_1$-$C_{14}$ alkyl group, and the other monomer M2 of the random copolymer A1 has the general formula (II-B):

(II-B)

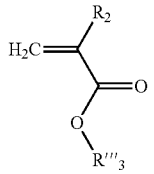

in which:

$R_2$ is selected from the group formed by —H, —$CH_3$ and —$CH_2$—$CH_3$, $R'''_3$ is a $C_{15}$-$C_{30}$ alkyl group.

According to an embodiment of the invention, the side chains of the random copolymer A1 have an average length ranging from 8 to 20 carbon atoms, preferably from 9 to 15 carbon atoms. According to an embodiment of the invention, the random copolymer A1 has a molar percentage of monomer M1 of formula (I) in said copolymer ranging from 1 to 30%, preferably from 5 to 25%, more preferably ranging from 9 to 21%.

According to an embodiment of the invention, the random copolymer A2 results from the copolymerization:

of at least one monomer M3 of formula (IV):

(IV)

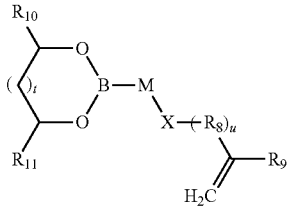

in which:

t is an integer equal to 0 or 1;

u is an integer equal to 0 or 1;

M and $R_8$ are divalent binding groups, identical or different, selected from the group formed by a $C_6$-$C_{18}$ aryl, a $C_7$-$C_{24}$ aralkyl and a $C_2$-$C_{24}$ alkyl, preferably a $C_6$-$C_{18}$ aryl, X is a function selected from the group formed by —O—C(O)—, —C(O)—O—, —C(O)—N(H)—, —N(H)—C(O)—, —S—, —N(H)—, —N($R'_4$)— and —O— with $R'_4$ a hydrocarbon-containing chain comprising from 1 to 15 carbon atoms;

$R_9$ is selected from the group formed by —H, —$CH_3$ and —$CH_2$—$CH_3$;

$R_{10}$ and $R_{11}$, identical or different, are selected from the group formed by hydrogen and a hydrocarbon-containing group having from 1 to 24 carbon atoms, preferably between 4 and 18 carbon atoms, preferably between 6 and 14 carbon atoms;

with at least one second monomer M4 of general formula (V):

(V)

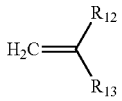

in which:

$R_{12}$ is selected from the group formed by —H, —$CH_3$ and —$CH_2$—$CH_3$, $R_{13}$ is selected from the group formed by a $C_6$-$C_{18}$ aryl, a $C_6$-$C_{18}$ aryl substituted with an $R'_{13}$ group, —C(O)—O—$R'_{13}$; —O—$R'_{13}$, —S—$R'_{13}$ and —C(O)—N(H)—$R'_{13}$ with $R'_{13}$ a $C_1$-$C_{25}$ alkyl group.

According to an embodiment of the invention, the chain formed by the linking together of the $R_{10}$, M, X and $(R_8)_u$ groups with u equal to 0 or 1 of the monomer of general formula (IV) of the random copolymer A2 has a total number of carbon atoms ranging from 8 to 38, preferably from 10 to 26. According to an embodiment of the invention, the side chains of the random copolymer A2 have an average length greater than or equal to 8 carbon atoms, preferably ranging from 11 to 16 carbon atoms. According to an embodiment of the invention, the random copolymer A2 has a molar percentage of monomer of formula (IV) in said copolymer ranging from 0.25 to 20%, preferably from 1 to 10%.

According to an embodiment of the invention, the exogenous compound A4 has the general formula (VI):

(VI)

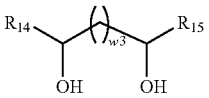

with:

$w_3$ an integer equal to 0 or 1;

$R_{14}$ and $R_{15}$, identical or different, selected from the group formed by hydrogen and a hydrocarbon-containing group having from 1 to 24 carbon atoms.

According to an embodiment, the substituents $R_{10}$, $R_{11}$ and the value of the index (t) of the monomer of formula (IV) of the random copolymer A2 are identical to the substituents $R_{14}$, $R_{15}$ and to the value of the index $w_3$ respectively, of the exogenous compound A4 of formula (VI). According to an embodiment of the invention, at least one of the substituents $R_{10}$, $R_{11}$ or the value of the index (t) of the monomer of formula (IV) of the random copolymer A2 is different from the substituents $R_{14}$, $R_{15}$ or the value of the index $w_3$ respectively, of the exogenous compound A4 of formula (VI). According to an embodiment of the invention, the weight ratio of the polydiol random copolymer A1 to the random copolymer A2 (A1/A2 ratio) ranges from 0.005 to 200, preferably from 0.05 to 20, even more preferably from 0.1 to 10, even more preferably from 0.2 to 5.

The present invention also relates to a lubricant composition resulting from mixing at least:

a lubricating oil; and a composition of additives defined above.

According to an embodiment of the invention, the lubricating oil is selected from the oils of group I, group II, group III, group IV, and group V of the API classification and a mixture thereof. According to an embodiment of the invention, the weight ratio of the random copolymer A1 to the random copolymer A2 (A1/A2 ratio) ranges from 0.001 to 100, preferably from 0.05 to 20, even more preferably from 0.1 to 10, even more preferably from 0.2 to 5. According to an embodiment of the invention, the molar percentage of exogenous compound A4 relative to the boronic ester functions of the random copolymer A2 ranges from 0.05 to 5000%, preferably ranges from 0.1% to 1000%, even more preferably from 0.5% to 500%, even more preferably from 1% to 150%. According to an embodiment of the invention, the lubricant composition of the invention results from additionally mixing a functional additive selected from the group formed by the detergents, antiwear additives, extreme pressure additives, additional antioxidants, viscosity index improving polymers, pour point improvers, antifoaming agents, anticorrosion additives, thickeners, dispersants, friction modifiers and mixtures thereof.

The present invention also relates to a process for modulating the viscosity of a lubricant composition, the process comprising at least:

supplying a lubricant composition resulting from mixing at least one lubricating oil, at least one polydiol random copolymer A1 and at least one random copolymer A2 comprising at least two boronic ester functions and able to associate with said polydiol random copolymer A1 by at least one transesterification reaction, adding, to said lubricant composition, at least one exogenous compound A4 selected from the 1,2-diols and the 1,3-diols.

The invention also proposes the use of at least one compound selected from the 1,2-diols or the 1,3-diols for modulating the viscosity of a lubricant composition, said lubricant composition resulting from mixing at least one lubricating oil, at least one polydiol random copolymer A1 and at least one random copolymer A2 comprising at least two boronic ester functions and able to associate with said polydiol random copolymer A1 by at least one transesterification reaction.

DETAILED DESCRIPTION

Composition of Additives

A first subject of the present invention is a composition of associative, thermoreversibly exchangeable additives the degree of association of which is controlled by the presence of a so-called exogenous compound, the composition resulting from mixing at least:

a polydiol random copolymer A1, a compound A2, in particular a random copolymer A2, comprising at least two boronic ester functions and able to associate with said polydiol random copolymer A1 by a reaction of transesterification, an exogenous compound A4 selected from the 1,2-diols and the 1,3-diols.

This composition of additives makes it possible to modulate the rheological behaviour of a medium to which it is added. The medium can be a hydrophobic medium, in particular apolar, such as a solvent, a mineral oil, a natural oil, a synthetic oil.

Polydiol Random Copolymers A1

The polydiol random copolymer A1 results from the copolymerization of at least one first monomer M1 bearing diol functions and at least one second monomer M2, of chemical structure different from that of monomer M1.

By "copolymer" is meant an oligomer or a linear or branched macromolecule having a sequence constituted by several repeating units (or monomer units) of which at least two units have a different chemical structure.

By "monomer unit" or "monomer" is meant a molecule that can be converted to an oligomer or a macromolecule by combining with itself or with other molecules of the same type. A monomer denotes the smallest constituent unit the repetition of which leads to an oligomer or a macromolecule.

Figure 1:
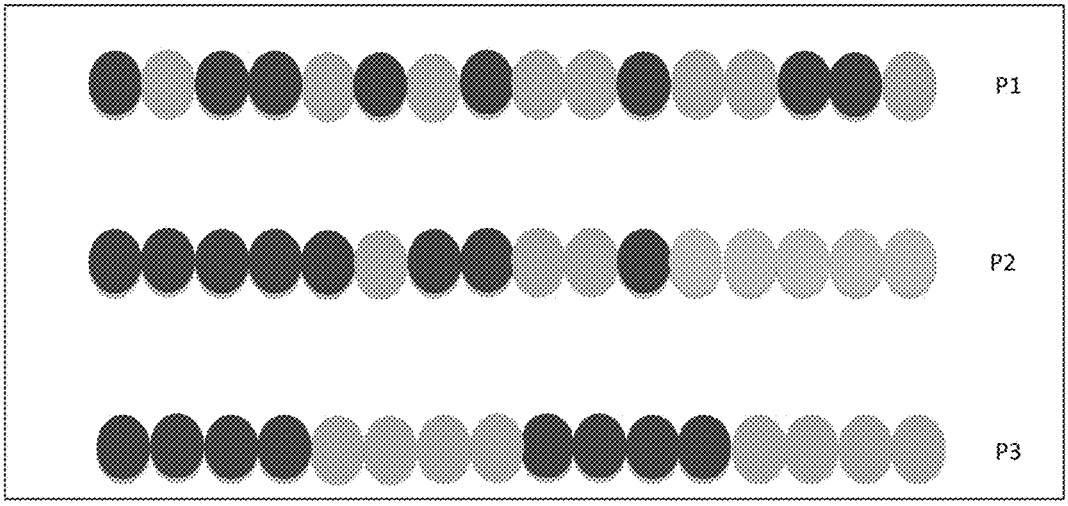
FIG. 1 is a schematic representation of a random copolymer (P1), a gradient copolymer (P2) and a block copolymer (P3), where each circle represents a monomer unit. The difference in chemical structure between the monomers is represented by a different colour (light grey/black).

By "random copolymer" is meant an oligomer or a macromolecule in which the sequential distribution of the monomer units obeys known statistical laws. For example, a copolymer is said to be random when it is constituted by monomer units the distribution of which is a Markov distribution. A schematic random polymer (P1) is illustrated in FIG. 1. The distribution of the monomer units in the polymer chain depends on the reactivity of the polymerizable functions of the monomers and the relative concentration of the monomers. The polydiol random copolymers of the invention are different from block copolymers and gradient copolymers. By "block" is meant a part of a copolymer comprising several monomer units, identical or different and which have at least one particular feature of constitution or of configuration by which it can be distinguished from the parts adjacent to it. A schematic block copolymer (P3) is illustrated in FIG. 1. A gradient copolymer denotes a copolymer with at least two monomer units of different structures the monomer composition of which changes gradually along the polymer chain, thus passing progressively from one end of the polymer chain rich in one monomer unit, to the other end rich in the other comonomer. A schematic gradient polymer (P2) is illustrated in FIG. 1.

By "copolymerization" is meant a process for converting a mixture of at least two monomer units of different chemical structures into an oligomer or a copolymer.

In the remainder of the present application, "B" represents a boron atom.

By "$C_i$-$C_j$ alkyl" is meant a saturated, linear or branched hydrocarbon-containing chain, comprising from i to j carbon atoms. For example, by "$C_1$-$C_{10}$ alkyl" is meant a saturated, linear or branched hydrocarbon-containing chain comprising from 1 to 10 carbon atoms.

By "$C_6$-$C_{18}$ aryl" is meant a functional group that is derived from an aromatic hydrocarbon-containing compound comprising from 6 to 18 carbon atoms.

This functional group can be monocyclic or polycyclic. As an illustration, a $C_6$-$C_{18}$ aryl can be phenyl, naphthalene, anthracene, phenanthrene and tetracene.

By "$C_2$-$C_{10}$ alkenyl" is meant a linear or branched hydrocarbon-containing chain comprising at least one unsaturation, preferably a carbon-carbon double bond, and comprising from 2 to 10 carbon atoms.

By "$C_7$-$C_{18}$ aralkyl" is meant an aromatic hydrocarbon-containing compound, preferably monocyclic, substituted with at least one linear or branched alkyl chain and in which the total number of carbon atoms of the aromatic ring and of its substituents ranges from 7 to 18 carbon atoms. As an illustration, a $C_7$-$C_{18}$ aralkyl can be selected from the group formed by benzyl, tolyl and xylyl.

By "$C_6$-$C_{18}$ aryl group substituted with an $R'_3$" group is meant an aromatic hydrocarbon-containing compound, preferably monocyclic, comprising from 6 to 18 carbon atoms, in which at least one carbon atom of the aromatic ring is substituted with an $R'_3$ group.

By "Hal" or "halogen" is meant a halogen atom selected from the group formed by chlorine, bromine, fluorine and iodine.

Monomer M1

The first monomer M1 of the polydiol random copolymer (A1) of the invention has the general formula (I):

(I)

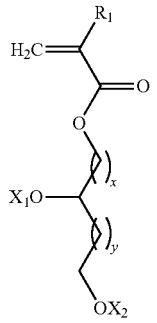

in which:

$R_1$ is selected from the group formed by —H, —$CH_3$ and —$CH_2$—$CH_3$, preferably —H and —$CH_3$;

x is an integer ranging from 1 to 18, preferably ranging from 2 to 18; more preferably from 3 to 8; even more preferably x is equal to 4;

y is an integer equal to 0 or 1; preferably y is equal to 0;

$X_1$ and $X_2$, identical or different, are selected from the group formed by hydrogen, tetrahydropyranyl, methyloxymethyl, tert-butyl, benzyl, trimethylsilyl and t-butyl dimethylsilyl;

or $X_1$ and $X_2$ form, with the oxygen atoms, a bridge of the following formula:

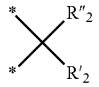

in which:

the stars (*) represent the bonds to the oxygen atoms, $R'_2$ and $R''_2$, identical or different, are selected from the group formed by hydrogen and a $C_1$-$C_{11}$ alkyl group;

or $X_1$ and $X_2$ form, with the oxygen atoms, a boronic ester of the following formula:

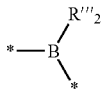

in which:

the stars (*) represent the bonds to the oxygen atoms, $R'''_2$ is selected from the group formed by a $C_6$-$C_{18}$ aryl, a $C_7$-$C_{18}$ aralkyl and a $C_2$-$C_{18}$ alkyl, preferably a $C_6$-$C_{18}$ aryl, more preferably phenyl.

Preferably, when $R'_2$ and $R''_2$ are a $C_1$-$C_{11}$ alkyl group, the hydrocarbon-containing chain is a linear chain. Preferably, the $C_1$-$C_{11}$ alkyl group is selected from the group formed by methyl, ethyl, n-propyl, n-butyl, n-pentyl, n-hexyl, n-heptyl, n-octyl, n-nonyl, n-decyl and n-undecyl. More preferably, the $C_1$-$C_{11}$ alkyl group is methyl. Preferably, when $R'''_2$ is a $C_2$-$C_{18}$ alkyl group, the hydrocarbon-containing chain is a linear chain.

Among the monomers of formula (I), the monomers corresponding to formula (I-A) are among those preferred:

(I-A)

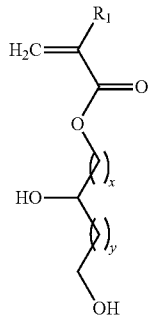

in which:

$R_1$ is selected from the group formed by —H, —$CH_3$ and —$CH_2$—$CH_3$, preferably —H and —$CH_3$;

x is an integer ranging from 1 to 18, preferably ranging from 2 to 18; more preferably from 3 to 8; even more preferably x is equal to 4;

y is an integer equal to 0 or 1; preferably y is equal to 0.

Among the monomers of formula (I), the monomers corresponding to formula (I-B) are among those preferred:

(I-B)

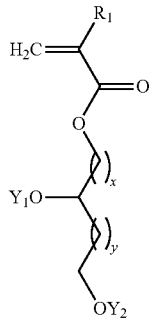

in which:

$R_1$ is selected from the group formed by —H, —$CH_3$ and —$CH_2$—$CH_3$, preferably —H and —$CH_3$;

x is an integer ranging from 1 to 18, preferably ranging from 2 to 18; more preferably from 3 to 8; even more preferably x is equal to 4;

y is an integer equal to 0 or 1; preferably y is equal to 0;

$Y_1$ and $Y_2$, identical or different, are selected from the group formed by tetrahydropyranyl, methyloxymethyl, tert-butyl, benzyl, trimethylsilyl and t-butyl dimethylsilyl;

or $Y_1$ and $Y_2$ form, with the oxygen atoms, a bridge of the following formula:

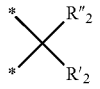

in which:

the stars (*) represent the bonds to the oxygen atoms, $R'_2$ and $R''_2$, identical or different, are selected from the group formed by hydrogen and a $C_1$-$C_{11}$ alkyl group;

or $Y_1$ and $Y_2$ form, with the oxygen atoms, a boronic ester of the following formula:

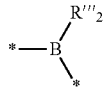

in which:

the stars (*) represent the bonds to the oxygen atoms, $R'''_2$ is selected from the group formed by a $C_6$-$C_{18}$ aryl, a $C_7$-$C_{18}$ aralkyl and a $C_2$-$C_{18}$ alkyl, preferably a $C_6$-$C_{18}$ aryl, more preferably phenyl.

Preferably, when $R'_2$ and $R''_2$ are a $C_1$-$C_{11}$ alkyl group, the hydrocarbon-containing chain is a linear chain. Preferably, the $C_1$-$C_{11}$ alkyl group is selected from the group formed by methyl, ethyl, n-propyl, n-butyl, n-pentyl, n-hexyl, n-heptyl, n-octyl, n-nonyl, n-decyl and n-undecyl. More preferably, the $C_1$-$C_{11}$ alkyl group is methyl. Preferably, when $R'''_2$ is a $C_2$-$C_{18}$ alkyl group, the hydrocarbon-containing chain is a linear chain.

Obtaining the Monomer M1

The monomer M1 of general formula (I-A) is obtained by deprotection of the alcohol functions of the monomer of general formula (I-B) according to reaction diagram 1 below:

Diagram 1

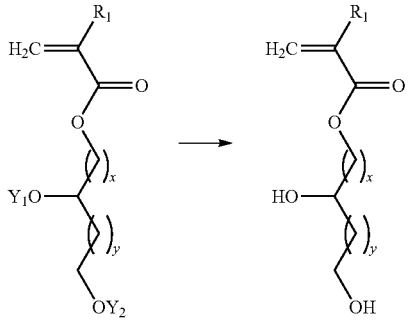

(I-B) (I-A)

with $R_1$, $Y_1$, $Y_2$, x and y as defined in general formula (I-B) described above.

The reaction of deprotection of the diol functions of the monomer of general formula (I-B) is well known to a person skilled in the art. He knows how to adapt the reaction conditions of deprotection as a function of the nature of the protective groups $Y_1$ and $Y_2$.

The monomer M1 of general formula (I-B) can be obtained by a reaction of a compound of general formula (I-c) with an alcohol compound of general formula (I-b) according to reaction diagram 2 below:

Diagram 2

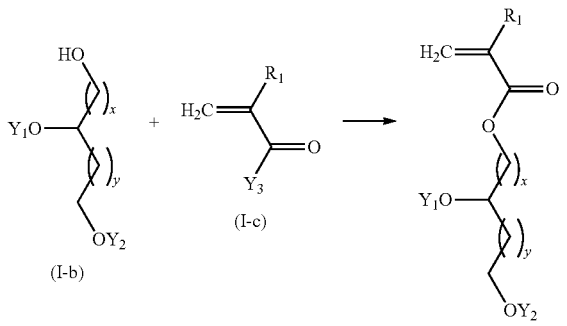

(I-b) (I-c) (I-B)

in which:

$Y_3$ is selected from the group formed by a halogen atom, preferably chlorine, —OH and O—C(O)—$R'_1$ with $R'_1$ selected from the group formed by —H, —$CH_3$ and —$CH_2$—$CH_3$, preferably —H and —$CH_3$;

$R_1$, $Y_1$, $Y_2$, x and y have the same meaning as that given in general formula (I-B).

These coupling reactions are well known to a person skilled in the art. The compound of general formula (I-c) is available commercially from the suppliers: Sigma-Aldrich® and Alfa Aesar®.

The alcohol compound of general formula (I-b) is obtained from the corresponding polyol of formula (I-a) by protecting the diol functions according to the following reaction diagram 3:

Diagram 3

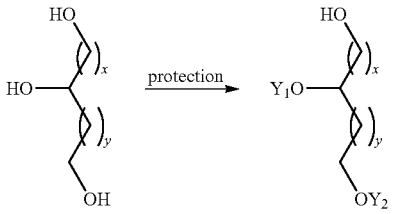

(I-a) (I-b)

with x, y, $Y_1$ and $Y_2$ as defined in general formula (I-B).

The reaction of protection of the diol functions of the compound of general formula (I-a) is well known to a person skilled in the art. He knows how to adapt the reaction conditions of protection as a function of the nature of the protective groups $Y_1$ and $Y_2$ used. The polyol of general formula (I-a) is available commercially from the suppliers: Sigma-Aldrich® and Alfa Aesar®.

Monomer M2

The second monomer of the random copolymer of the invention has general formula (II):

(II)

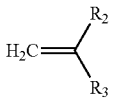

in which:

$R_2$ is selected from the group formed by —H, —$CH_3$ and —$CH_2$—$CH_3$, preferably —H and —$CH_3$;

$R_3$ is selected from the group formed by a $C_6$-$C_{18}$ aryl group, a $C_6$-$C_{18}$ aryl substituted with an $R'_3$ group, —C(O)—O—$R'_3$; —O—$R'_3$, —S—$R'_3$ and —C(O)—N(H)—$R'_3$ with $R'_3$ a $C_1$-$C_{30}$ alkyl group.

Preferably, $R'_3$ is a $C_1$-$C_{30}$ alkyl group the hydrocarbon-containing chain of which is linear.

Among the monomers of formula (II), the monomers corresponding to formula (II-A) are among those preferred:

(II-A)

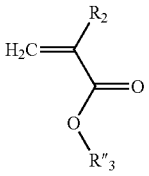

in which:

$R_2$ is selected from the group formed by —H, —$CH_3$ and —$CH_2$—$CH_3$, preferably —H and —$CH_3$;

$R''_3$ is a $C_1$-$C_{14}$ alkyl group.

By "$C_1$-$C_{14}$ alkyl group" is meant a saturated, linear or branched hydrocarbon-containing chain comprising from 1 to 14 carbon atoms. Preferably, the hydrocarbon-containing chain is linear. Preferably, the hydrocarbon-containing chain comprises from 4 to 12 carbon atoms.

Among the monomers of formula (II), the monomers corresponding to formula (II-B) also are among those preferred:

(II-B)

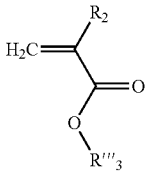

in which:

$R_2$ is selected from the group formed by —H, —$CH_3$ and —$CH_2$—$CH_3$, preferably —H and —$CH_3$;

$R'''_3$ is a $C_{15}$-$C_{30}$ alkyl group.

By "$C_{15}$-$C_{30}$ alkyl group" is meant a saturated, linear or branched hydrocarbon-containing chain comprising from 15 to 30 carbon atoms. Preferably, the hydrocarbon-containing chain is linear. Preferably, the hydrocarbon-containing chain comprises 16 to 24 carbon atoms.

Obtaining the Monomer M2

The monomers of formula (II), (II-A), and (II-B) are well known to a person skilled in the art. They are marketed by Sigma-Aldrich® and TCI®.

Preferred Polydiol Copolymers

In an embodiment, a preferred random copolymer results from the copolymerization of at least:

a first monomer M1 of general formula (I) as described above; in particular of general formula (I-A) as described above;

a second monomer M2 of formula (II) as described above, in which $R_2$ is —H and $R_3$ is a $C_6$-$C_{18}$ aryl group; preferably $R_3$ is phenyl.

In another embodiment, a preferred random copolymer results from the copolymerization of at least:

a first monomer M1 of general formula (I) as described above; in particular of general formula (I-A) as described above;

a second monomer M2 of formula (II-A) as described above; and a third monomer M2 of formula (II-B) as described above.

According to this other embodiment, a preferred random copolymer results from the copolymerization of at least:

a first monomer M1 of general formula (I) as described above; in particular of general formula (I-A) as described above;

a second monomer M2 of formula (II-A) in which $R_2$ is —$CH_3$ and $R''_3$ is a $C_4$-$C_{12}$ alkyl group, preferably a linear $C_4$-$C_{12}$ alkyl;

a third monomer M2 of formula (II-B) in which $R_2$ is —$CH_3$ and $R'''_3$ is a $C_{16}$-$C_{24}$ alkyl group, preferably a linear $C_{16}$-$C_{24}$ alkyl.

According to this embodiment, a preferred random copolymer results from the copolymerization of at least:

a first monomer M1 of general formula (I) as described above; in particular of general formula (I-A) as described above;

a second monomer M2 selected from the group comprising n-octyl methacrylate, n-decyl methacrylate and n-dodecyl methacrylate;

a third monomer M2 selected from the group formed by palmityl methacrylate, stearyl methacrylate, arachidyl methacrylate and behenyl methacrylate.

Process for Obtaining the Polydiol Copolymers

A person skilled in the art is able to synthesize the polydiol random copolymers A1 by applying his general knowledge. The copolymerization can be initiated in the bulk or in solution in an organic solvent by compounds that generate free radicals. For example, the copolymers of the invention are obtained by the known processes of radical copolymerization, in particular controlled, such as the method called controlled radical polymerization by reversible addition-fragmentation chain transfer (RAFT) and the method called atom transfer radical polymerization (ATRP). Conventional radical polymerization and telomerization can also be used for preparing the copolymers of the invention (Moad, G.; Solomon, D. H., The Chemistry of Radical Polymerization. 2nd ed.; Elsevier Ltd: 2006; p 639; Matyjaszewski, K.; Davis, T. P. Handbook of Radical Polymerization; Wiley-Interscience: Hoboken, 2002; p 936).

The polydiol random copolymer A1 is prepared by a process of preparation that comprises at least one polymerization step (a) in which at least the following are brought into contact:

i) a first monomer M1 of general formula (I) as described above:

ii) at least one second monomer M2 of general formula (II):

iii) at least one source of free radicals.

In an embodiment, the process can further comprise iv) at least one chain transfer agent.

By "a source of free radicals" is meant a chemical compound allowing a chemical species having one or more unpaired electrons on its outer shell to be generated. A person skilled in the art can use any source of free radicals known per se and suitable for polymerization processes, in particular controlled radical polymerization. The preferred sources of free radicals include, for purposes of illustration, benzoyl peroxide, tert-butyl peroxide, diazo compounds such as azobisisobutyronitrile, peroxidized compounds such as the persulphates or hydrogen peroxide, redox systems such as the oxidation of $Fe^{2+}$, persulphate/sodium-metabisulphite mixtures, or ascorbic acid/hydrogen peroxide or compounds that are cleavable photochemically or by ionizing radiation, for example ultraviolet radiation or beta or gamma radiation.

By "chain transfer agent" is meant a compound the purpose of which is to ensure homogeneous growth of the macromolecular chains by reversible transfer reactions between species undergoing growth, i.e. polymer chains terminated by a carbon-containing radical, and dormant species, i.e. polymer chains terminated by a transfer agent. This reversible transfer process makes it possible to control the molecular weights of copolymers prepared in this way. Preferably, in the process of the invention, the chain transfer agent comprises a thiocarbonylthio group —S—C(=S)—. As an illustration of chain transfer agents, the dithioesters, trithiocarbonates, xanthates and dithiocarbamates can be mentioned. A preferred transfer agent is cumyl dithiobenzoate or 2-cyano-2-propyl benzodithioate.

By "chain transfer agent" is also meant a compound the purpose of which is to limit the growth of the macromolecular chains in the course of formation by adding monomer molecules and to initiate new chains, which makes it possible to limit the final molecular weights, or even control them. A transfer agent of this type is used in telomerization. A preferred transfer agent is cysteamine.

In an embodiment, the process for preparing a polydiol random copolymer comprises:

at least one polymerization step (a) as defined above, in which the monomers M1 and M2 are selected with $X_1$ and $X_2$ different from hydrogen, and in addition at least one step of deprotection (b) of the diol functions of the copolymer obtained at the end of step (a), so as to obtain a copolymer in which $X_1$ and $X_2$ are identical and are a hydrogen atom.

In an embodiment, the polymerization step (a) comprises bringing at least one monomer M1 into contact with at least two monomers M2 having different $R_3$ groups. In this embodiment, one of the monomers M2 has the general formula (II-A) as defined above and the other monomer M2 has the general formula (II-B) as defined above. The preferences and definitions described for general formulae (I), (I-A), (I-B), (II-A), (II-B) also apply to the processes described above.

Properties of the Polydiol Copolymers A1

Figure 2:
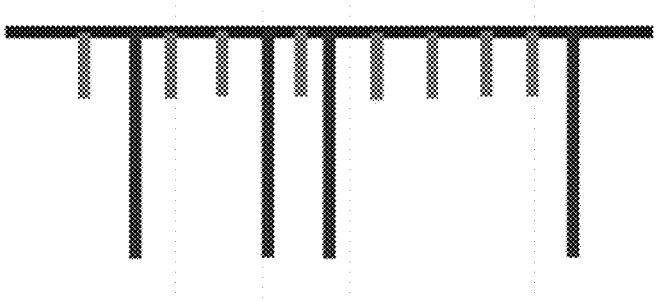
FIG. 2 is a schematic representation of a comb copolymer.

The polydiol random copolymers A1 are comb copolymers. By "comb copolymers" is meant a copolymer having a main chain (also called backbone) and side chains. The side chains are pendant on either side of the main chain. The length of each side chain is less than the length of the main chain. FIG. 2 is a schematic representation of a comb polymer.

The copolymers A1 have a backbone of polymerizable functions, in particular a backbone of methacrylate functions or styrene functions, and a mixture of hydrocarbon-containing side chains, substituted or not substituted with diol functions. As the monomers of formula (I) and (II) have polymerizable functions of identical or substantially identical reactivity, a copolymer is obtained in which the monomers having diol functions are distributed randomly along the backbone of the copolymer relative to the monomers the alkyl chains of which are not substituted with diol functions.

The polydiol random copolymers A1 have the advantage that they are sensitive to external stimuli, such as temperature, pressure, and shearing rate; this sensitivity is reflected in a change of properties. In response to a stimulus, the spatial conformation of the copolymer chains is altered and the diol functions are made more or less accessible to the reactions of association, which can produce cross-linking, as well as to the exchange reactions. These processes of association and of exchange are reversible. The random copolymer A1 is a heat-sensitive copolymer, i.e. it is sensitive to temperature changes.

Advantageously, the side chains of the polydiol random copolymer A1 have an average length ranging from 8 to 20 carbon atoms, preferably from 9 to 15 carbon atoms. By "average length of side chain" is meant the average length of the side chains of each monomer making up the copolymer. A person skilled in the art knows how to obtain this average length by appropriate selection of the types and the ratio of monomers constituting the polydiol random copolymer. By selecting this average chain length, it is possible to obtain a polymer that is soluble in a hydrophobic medium, whatever the temperature at which the copolymer is dissolved. The polydiol random copolymer A1 is therefore miscible in a hydrophobic medium. By "hydrophobic medium" is meant a medium that has very little or no affinity for water, i.e. it is not miscible in water or in an aqueous medium.

Advantageously, the polydiol random copolymer A1 has a molar percentage of monomer M1 of formula (I) in said copolymer ranging from 1 to 30%, preferably 5 to 25%, more preferably ranging from 9 to 21%. In a preferred embodiment, the polydiol random copolymer A1 has a molar percentage of monomer M1 of formula (I) in said copolymer ranging from 1 to 30%, preferably 5 to 25%, more preferably ranging from 9 to 21%, a molar percentage of monomer M2 of formula (II-A) in said copolymer ranging from 8 to 92% and a molar percentage of monomer M2 of formula (II-B) in said copolymer ranging from 0.1 to 62%. The molar percentage of monomers in the copolymer is the direct result of adjustment of the quantities of monomers used for synthesis of the copolymer.

In a preferred embodiment, the polydiol random copolymer A1 has a molar percentage of monomer M1 of formula (I) in said copolymer ranging from 1 to 30%, a molar percentage of monomer M2 of formula (II-A) in said copolymer ranging from 8 to 62% and a molar percentage of monomer M2 of formula (II-B) in said copolymer ranging from 8 to 91%. The molar percentage of monomers in the copolymer is the direct result of adjustment of the quantities of monomers used for synthesis of the copolymer. Advantageously, the polydiol random copolymer A1 has a number-average degree of polymerization ranging from 100 to 2000, preferably from 150 to 1000. As is known, the degree of polymerization is controlled using a technique of controlled radical polymerization, a technique of telomerization or by adjusting the quantity of the source of free radicals when the copolymers of the invention are prepared by conventional radical polymerization.

Advantageously, the polydiol random copolymer A1 has a polydispersity index (PDI) ranging from 1.05 to 3.75; preferably ranging from 1.10 to 3.45. The polydispersity index is obtained by measurement by size exclusion chromatography using polystyrene calibration. Advantageously, the polydiol random copolymer A1 has a number-average molecular weight ranging from 10,000 to 400,000 g/mol, preferably from 25,000 to 150,000 g/mol, the number-average molecular weight being obtained by measurement by size exclusion chromatography using polystyrene calibration. The method of measurement by size exclusion chromatography using polystyrene calibration is described in the work (Fontanille, M.; Gnanou, Y., Chimie et physicochimie des polymères [Chemistry and physical chemistry of polymers]. 2nd ed.; Dunod: 2010; p 546).

Compound A2

Boronic Diester Compound A2

In an embodiment, compound A2 comprising two boronic ester functions has the general formula (III):

(III)

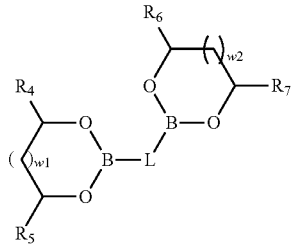

in which:

$w_1$ and $w_2$, identical or different, are integers equal to 0 or 1, $R_4$, $R_5$, $R_6$ and $R_7$, identical or different, are selected from the group formed by hydrogen and a hydrocarbon-containing group having from 1 to 24 carbon atoms, preferably from 4 to 18 carbon atoms, preferably from 6 to 14 carbon atoms;

L is a divalent binding group and is selected from the group formed by a $C_6$-$C_{18}$ aryl, a $C_7$-$C_{24}$ aralkyl and a $C_2$-$C_{24}$ hydrocarbon-containing chain, preferably a $C_6$-$C_{18}$ aryl.

By "hydrocarbon-containing group having from 1 to 24 carbon atoms" is meant a linear or branched alkyl or alkenyl group having from 1 to 24 carbon atoms. Preferably, the hydrocarbon-containing group comprises from 4 to 18 carbon atoms, preferably from 6 to 14 carbon atoms. Preferably, the hydrocarbon-containing group is a linear alkyl.

By "$C_2$-$C_{24}$ hydrocarbon-containing chain" is meant a linear or branched alkyl or alkenyl group comprising from 2 to 24 carbon atoms. Preferably, the hydrocarbon-containing chain is a linear alkyl group. Preferably the hydrocarbon-containing chain comprises from 6 to 16 carbon atoms.

In an embodiment of the invention, compound A2 is a compound of general formula (III) above in which:

$w_1$ and $w_2$, identical or different, are integers equal to 0 or 1;

$R_4$ and $R_6$ are identical and are hydrogen atoms;

$R_5$ and $R_7$ are identical and are a hydrocarbon-containing group, preferably a linear alkyl, having from 1 to 24 carbon atoms, preferably from 4 to 18 carbon atoms, preferably from 6 to 16 carbon atoms;

L is a divalent binding group and is a $C_6$-$C_{18}$ aryl, preferably phenyl.

The boronic diester compound A2 of formula (III) as described above is obtained by a condensation reaction between a boronic acid of general formula (III-a) and diol functions of the compounds of general formula (III-b) and (III-c) according to reaction diagram 4 below:

Diagram 4

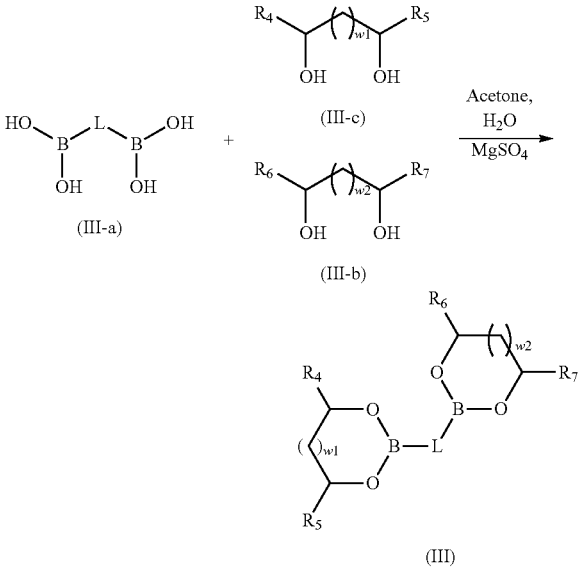

with $w_1$, $w_2$, L, $R_4$, $R_5$, $R_6$ and $R_7$ as defined above.

In fact, by condensation of the boronic acid functions of compound (III-a) with diol functions of the compounds of formula (III-b) and of formula (III-c), compounds are obtained having two boronic ester functions (compound of formula (III)). This step is carried out by means well known to a person skilled in the art.

In the context of the present invention, the compound of general formula (III-a) is dissolved, in the presence of water, in a polar solvent such as acetone. The presence of water makes it possible to shift the chemical equilibria between the molecules of boronic acid of formula (III-a) and the molecules of boroxine obtained from the boronic acids of formula (III-a). In fact, it is well known that the boronic acids can form molecules of boroxine spontaneously at ambient temperature. Now, the presence of molecules of boroxine is undesirable in the context of the present invention.

The condensation reaction takes place in the presence of a dehydrating agent such as magnesium sulphate. This agent makes it possible to trap the water molecules introduced initially as well as those that are released by the condensation between the compound of formula (III-a) and the compound of formula (III-b) and between the compound of formula (III-a) and the compound of formula (III-c). In an embodiment, the compound (III-b) and the compound (III-c) are identical. A person skilled in the art knows how to adapt the quantities of regents of formula (III-b) and/or (III-c) and of formula (III-a) in order to obtain the product of formula (III).

Poly(Boronic Ester) Random Copolymer Compound A2

In another embodiment, compound A2 comprising at least two boronic ester functions is a poly(boronic ester) random copolymer resulting from the copolymerization of at least one monomer M3 of formula (IV) as described below with at least one monomer M4 of formula (V) as described below. In the remainder of the application, the expressions "boronic ester random copolymer" or "poly(boronic ester) random copolymer" are equivalent and denote the same copolymer.

Monomer M3 of Formula (IV)

The monomer M3 of the boronic ester random copolymer compound A2 has general formula (IV):

(IV)

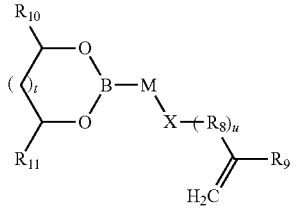

in which:

t is an integer equal to 0 or 1;

u is an integer equal to 0 or 1;

M and $R_8$ are divalent binding groups, identical or different, and are selected from the group formed by a $C_6$-$C_{18}$ aryl, a $C_7$-$C_{24}$ aralkyl and $C_2$-$C_{24}$ alkyl, preferably a $C_6$-$C_{18}$ aryl, X is a function selected from the group formed by —O—C(O)—, —C(O)—O—, —C(O)—N(H)—, —N(H)—C(O)—, —S—, —N(H)—, —N(R'$_4$)— and —O— with R'$_4$ a hydrocarbon-containing chain comprising from 1 to 15 carbon atoms;

$R_9$ is selected from the group formed by —H, —$CH_3$ and —$CH_2$—$CH_3$; preferably —H and —$CH_3$;

$R_{10}$ and $R_{11}$, identical or different, are selected from the group formed by hydrogen and a hydrocarbon-containing chain having from 1 to 24 carbon atoms, preferably between 4 and 18 carbon atoms, preferably between 6 and 12 carbon atoms;

By "$C_2$-$C_{24}$ alkyl" is meant a saturated, linear or branched hydrocarbon-containing chain comprising from 2 to 24 carbon atoms. Preferably, the hydrocarbon-containing chain is linear. Preferably the hydrocarbon-containing chain comprises from 6 to 16 carbon atoms.

By "hydrocarbon-containing chain comprising from 1 to 15 carbon atoms" is meant a linear or branched alkyl or alkenyl group comprising from 1 to 15 carbon atoms. Preferably, the hydrocarbon-containing chain is a linear alkyl group. Preferably, it comprises from 1 to 8 carbon atoms.

By "hydrocarbon-containing chain comprising from 1 to 24 carbon atoms" is meant a linear or branched alkyl or alkenyl group comprising from 1 to 24 carbon atoms. Preferably, the hydrocarbon-containing chain is a linear alkyl group. Preferably, it comprises from 4 to 18 carbon atoms, preferably between 6 and 12 carbon atoms.

In an embodiment, the monomer M3 has the general formula (IV) in which:

t is an integer equal to 0 or 1;

u is an integer equal to 0 or 1;

M and $R_8$ are divalent binding groups and are different, M is a $C_6$-$C_{18}$ aryl, preferably phenyl, $R_8$ is a $C_7$-$C_{24}$ aralkyl, preferably benzyl;

X is a function selected from the group formed by —O—C(O)—, —C(O)—O—, —C(O)—N(H)— and —O—, preferably —C(O)—O— or —O—C(O)—;

$R_9$ is selected from the group formed by —H, —$CH_3$, preferably —H;

$R_{10}$ and $R_{11}$ are different, one of the $R_{10}$ or $R_{11}$ groups is H and the other $R_{10}$ or $R_{11}$ group is a hydrocarbon-containing chain, preferably a linear alkyl group having from 1 to 24 carbon atoms, preferably between 4 and 18 carbon atoms, preferably between 6 and 12 carbon atoms.

Synthesis of Monomer M3 of Formula (IV)

In all the diagrams presented below, unless stated otherwise, the variables $R_{10}$, $R_{11}$, M, u, t, X, $R_8$, R'$_4$ and $R_9$ have the same definition as in formula (IV) above. The monomers M3 of formula (IV) are in particular obtained by a process of preparation comprising at least one step of condensation of a boronic acid of general formula (IV-f) with a diol compound of general formula (IV-g) according to reaction diagram 5 below:

Diagram 5

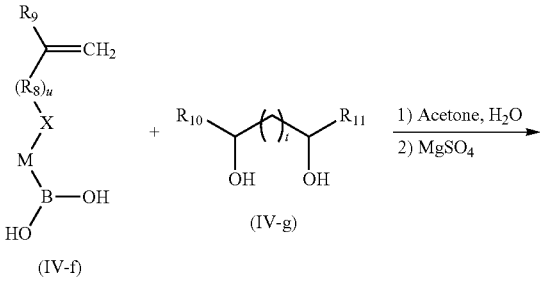

-continued

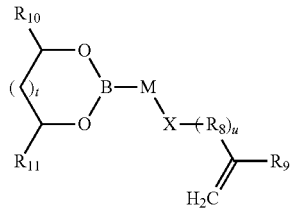

(IV)

In fact, by condensation of the boronic acid functions of the compound of formula (IV-f) with diol functions of the compounds of formula (IV-g), a boronic ester compound of formula (IV) is obtained. This step is carried out by methods that are well known to a person skilled in the art. In the context of the present invention, the compound of general formula (IV-f) is dissolved, in the presence of water, in a polar solvent such as acetone. The condensation reaction takes place in the presence of a dehydrating agent, such as magnesium sulphate. The compounds of formula (IV-g) are available commercially from the following suppliers: Sigma-Aldrich®, Alfa Aesar® and TCI®. The compound of formula (IV-f) is obtained directly from the compound of formula (IV-e) by hydrolysis according to the following reaction diagram 6:

Diagram 6

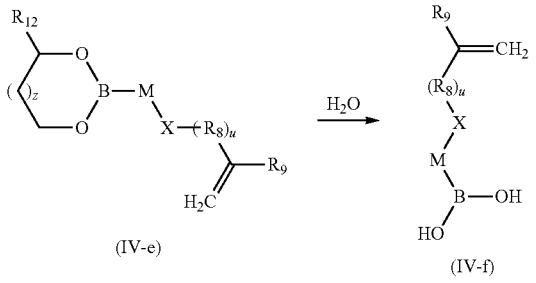

(IV-e) (IV-f)

with z an integer equal to 0 or 1;

$R_{12}$ is selected from the group formed by —H, —$CH_3$ and —$CH_2$—$CH_3$;

u, X, M, $R_8$ and $R_9$ as defined above.

The compound of formula (IV-e) is obtained by reaction of a compound of formula (IV-c) with a compound of formula (IV-d) according to the following reaction diagram 7:

Diagram 7

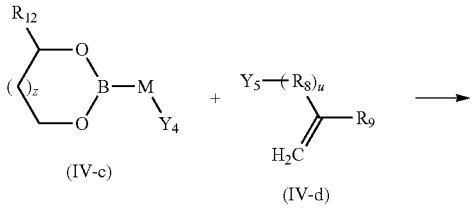

(IV-c) (IV-d)

-continued

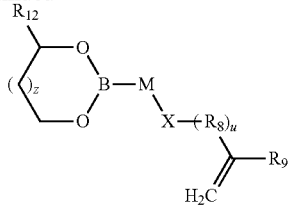

(IV-e)

with z, u, $R_{12}$, M, $R'_4$, $R_9$ and $R_8$ as defined above;

and in this diagram:

when X represents —O—C(O)—, $Y_4$ represents an alcohol function —OH or a halogen atom, preferably chlorine or bromine and $Y_5$ is a carboxylic acid function —C(O)—OH;

when X represents —C(O)—O—, $Y_4$ represents a carboxylic acid function —C(O)—OH and $Y_5$ is an alcohol function —OH or a halogen atom, and preferably chlorine or bromine;

when X represents —C(O)—N(H)—, $Y_4$ represents a carboxylic acid function —C(O)—OH or a function —C(O)-Hal, and $Y_5$ is an amine function $NH_2$;

when X represents —N(H)—C(O)—, $Y_4$ represents an amine function $NH_2$ and $Y_5$ is a carboxylic acid function —C(O)—OH or a function —C(O)-Hal;

when X represents —S—, $Y_4$ is a halogen atom and $Y_5$ is a thiol function —SH or $Y_4$ is a thiol function —SH and $Y_5$ is a halogen atom;

when X represents —N(H)—, $Y_4$ is a halogen atom and $Y_5$ is an amine function —$NH_2$ or $Y_4$ is an amine function —$NH_2$ and $Y_5$ is a halogen atom;

when X represents —N($R'_4$)—, $Y_4$ is a halogen atom and $Y_5$ is an amine function —N(H)($R'_4$) or $Y_4$ is an amine function —N(H)($R'_4$) and $Y_5$ is a halogen atom;

when X represents —O—, $Y_4$ is a halogen atom and $Y_5$ is an alcohol function —OH or $Y_4$ is an alcohol function —OH and $Y_5$ is a halogen atom.

These reactions of esterification, etherification, thioetherification, alkylation or condensation between an amine function and a carboxylic acid function are well known to a person skilled in the art. A person skilled in the art therefore knows how to select the reaction conditions as a function of the chemical nature of the $Y_1$ and $Y_2$ groups in order to obtain the compound of formula (IV-e). The compounds of formula (IV-d) are available commercially from the suppliers: Sigma-Aldrich®, TCI® and Acros Organics®.

The compound of formula (IV-c) is obtained by a condensation reaction between a boronic acid of formula (IV-a) with at least one diol compound of formula (IV-b) according to the following reaction diagram 8:

Diagram 8

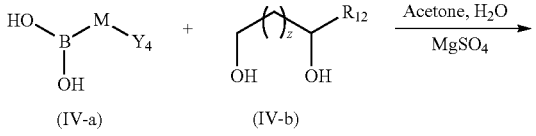

(IV-a) (IV-b)

-continued

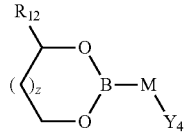

(IV-c)

with M, $Y_4$, z and $R_{12}$ as defined above,

Among the compounds of formula (IV-b), that in which $R_{12}$ is methyl and z=0 is preferred. The compounds of formula (IV-a) and (IV-b) are available commercially from the following suppliers: Sigma-Aldrich®, Alfa Aesar® and TCI®.

Monomer M4 of General Formula (V):

The monomer M4 of the boronic ester random copolymer compound A2 has the general formula (V)

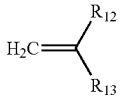

(V)

in which:

$R_{12}$ is selected from the group formed by —H, —$CH_3$ and —$CH_2$—$CH_3$, preferably —H and —$CH_3$;

$R_{13}$ is selected from the group formed by a $C_6$-$C_{18}$ aryl, a $C_6$-$C_{18}$ aryl substituted with an $R'_{13}$ group, —C(O)—O—$R'_{13}$; —O—$R'_{13}$, —S—$R'_{13}$ and —C(O)—N(H)—$R'_{13}$ with $R'_{13}$ a $C_1$-$C_{25}$ alkyl group.

By "$C_1$-$C_{25}$ alkyl group" is meant a saturated, linear or branched hydrocarbon-containing chain comprising from 1 to 25 carbon atoms. Preferably, the hydrocarbon-containing chain is linear. By "$C_6$-$C_{18}$ aryl group substituted with an $R_{13}$" group is meant an aromatic hydrocarbon-containing compound comprising from 6 to 18 carbon atoms in which at least one carbon atom of the aromatic ring is substituted with a $C_1$-$C_{25}$ alkyl group as defined above.

Among the monomers of formula (V), the monomers corresponding to formula (V-A) are among those preferred:

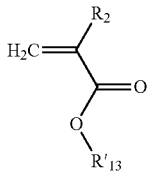

(V-A)

in which:

$R_2$ is selected from the group formed by —H, —$CH_3$ and —$CH_2$—$CH_3$, preferably —H and —$CH_3$;

$R'_{13}$ a $C_1$-$C_{25}$ alkyl group, preferably a $C_1$-$C_{25}$ linear alkyl, even more preferably a $C_1$-$C_{15}$ linear alkyl.

Obtaining the Monomer M4:

The monomers of formulae (V) and (V-A) are well known to a person skilled in the art. They are marketed by Sigma-Aldrich® and TCI®.

Synthesis of the Poly(Boronic Ester) Random Copolymer Compound A2

A person skilled in the art is able to synthesize the boronic ester random copolymers by applying his general knowledge. The copolymerization can be initiated in the bulk or in solution in an organic solvent by compounds that generate free radicals. For example, the boronic ester random copolymers are obtained by the known processes of radical copolymerization, in particular controlled such as the method called controlled radical polymerization by reversible addition-fragmentation chain transfer (RAFT) and the method called controlled atom transfer radical polymerization (ATRP). Conventional radical polymerization and telomerization can also be used for preparing the copolymers of the invention (Moad, G.; Solomon, D. H., The Chemistry of Radical Polymerization. 2nd ed.; Elsevier Ltd: 2006; p 639; Matyjaszewski, K.; Davis, T. P. Handbook of Radical Polymerization; Wiley-Interscience: Hoboken, 2002; p 936).

The boronic ester random copolymer is prepared by a process that comprises at least one polymerization step (a) in which the following are brought into contact:

i) at least one first monomer M3 of general formula (IV) as defined above;

ii) at least one second monomer M4 of general formula (V) as defined above;

iii) at least one source of free radicals.

In an embodiment, the process can further comprise iv) at least one chain transfer agent. The preferences and definitions described for general formulae (IV) and (V) also apply to the process. The sources of radicals and the transfer agents are those that were described for the synthesis of polydiol random copolymers. The preferences described for the sources of radicals and the transfer agents also apply to this process.

Properties of the Poly(Boronic Ester) Random Copolymer Compounds A2:

Advantageously, the chain formed by linking together the $R_{10}$, M, $(R_8)_u$ groups with u, an integer equal to 0 or 1, and X of the monomer M3 of general formula (IV) has a total number of carbon atoms ranging from 8 to 38, preferably ranging from 10 to 26. Advantageously, the side chains of the boronic ester random copolymer have an average length greater than 8 carbon atoms, preferably ranging from 11 to 16. This chain length makes it possible to dissolve the boronic ester random copolymer in a hydrophobic medium. By "average length of side chain" is meant the average length of the side chains of each monomer constituting the copolymer. A person skilled in the art knows how to obtain this average length by appropriate selection of the types and the ratio of monomers constituting the boronic ester random copolymer.

Advantageously, the boronic ester random copolymer has a molar percentage of monomer of formula (IV) in said copolymer ranging from 0.25 to 20%, preferably from 1 to 10%. Advantageously, the boronic ester random copolymer has a molar percentage of monomer of formula (IV) in said copolymer ranging from 0.25 to 20%, preferably from 1 to 10% and a molar percentage of monomer of formula (V) in said copolymer ranging from 80 to 99.75%, preferably from 90 to 99%.

Advantageously, the boronic ester random copolymer has a number-average degree of polymerization ranging from 50 to 1500, preferably from 80 to 800. Advantageously, the boronic ester random copolymer has a polydispersity index (PDI) ranging from 1.04 to 3.54; preferably ranging from 1.10 to 3.10. These values are obtained by size exclusion chromatography using tetrahydrofuran as eluent and polystyrene calibration. Advantageously, the boronic ester random copolymer has a number-average molecular weight ranging from 10,000 to 200,000 g/mol, preferably from 25,000 to 100,000 g/mol. These values are obtained by size exclusion chromatography using tetrahydrofuran as eluent and polystyrene calibration.

The compound A2, in particular the boronic ester random copolymer, has the property of being able to react in a hydrophobic medium, in particular apolar, with a compound bearing diol function(s) by a transesterification reaction. This transesterification reaction can be represented by the following diagram 9:

Diagram 9

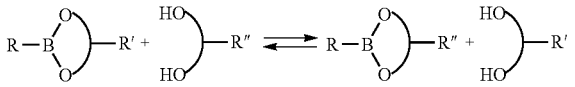

Thus, in a reaction of transesterification, there is formation of a boronic ester with a chemical structure different from the starting boronic ester by exchange of the hydrocarbon-containing groups represented by

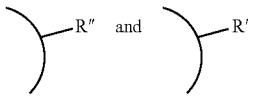

Exogenous Compound A4

The exogenous compound A4 is selected from the 1,2-diols and the 1,3-diols. By "exogenous compound" is meant, within the meaning of the present invention, a compound that is added to the composition of additives resulting from mixing at least one polydiol random copolymer A1 and at least one compound A2, in particular the poly(boronic ester) random copolymer.

The exogenous compound A4 can have the general formula (VI):

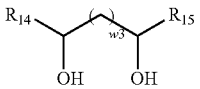

(VI)

in which:

w3 is an integer equal to 0 or 1, $R_{14}$ and $R_{15}$, identical or different, are selected from the group formed by hydrogen and a hydrocarbon-containing chain having from 1 to 24 carbon atoms, preferably between 4 and 18 carbon atoms, preferably between 6 and 12 carbon atoms;

By "hydrocarbon-containing chain comprising from 1 to 24 carbon atoms" is meant a linear or branched alkyl or alkenyl group comprising from 1 to 24 carbon atoms. Preferably, the hydrocarbon-containing chain is a linear alkyl group. Preferably, it comprises from 4 to 18 carbon atoms, preferably between 6 and 12 carbon atoms.

In an embodiment, the exogenous compound A4 has the general formula (VI) in which:

$w_3$ is an integer equal to 0 or 1;

$R_{14}$ and $R_{15}$ are different, one of the $R_{14}$ or $R_{15}$ groups is H and the other $R_{14}$ or $R_{15}$ group is a hydrocarbon-containing chain, preferably a linear alkyl group having from 1 to 24 carbon atoms, preferably between 4 and 18 carbon atoms, preferably between 6 and 12 carbon atoms.

In an embodiment, the exogenous compound A4 has a chemical structure different from the diol compound A3 released in situ by a transesterification reaction. In this embodiment, at least one of the substituents $R_{14}$, $R_{15}$ or the value of the index $w_3$ of the exogenous compound A4 of formula (VI) is different respectively from the substituents $R_4$ and $R_5$ or the value of the index $w_1$ or substituents $R_5$ and $R_7$ or the value of the index $w_2$ of the boronic diester compound A2 of formula (III) or is different respectively from the substituents $R_{10}$, $R_{11}$ or the value of the index t of the monomer (IV) of the poly(boronic ester) random copolymer A2.

In another embodiment, the exogenous compound A4 has a chemical structure identical to the diol compound A3 released in situ by a transesterification reaction. In this embodiment, the substituents $R_{14}$, $R_{15}$ and the value of the index $w_3$ of the exogenous compound A4 of formula (VI) are identical respectively to the substituents $R_4$ and $R_5$ and to the value of the index $w_1$ or to $R_5$ and $R_7$ and to the value of the index $w_2$ of the boronic diester compound A2 of formula (III) or is identical respectively to the substituents $R_{10}$, $R_{11}$ and to the value of the index t of the monomer (IV) of the poly(boronic ester) random copolymer A2. Depending on its temperature of use, the composition of additives resulting from mixing at least one polydiol random copolymer A1, at least one compound A2, in particular a random copolymer A2, comprising at least two boronic ester functions and able to associate with said polydiol random copolymer A1 by a transesterification reaction, and from adding at least one exogenous compound A4 as defined above, can further comprise a diol compound A3 released in situ, identical to the exogenous compound A4 added to the composition.

By "diol released in situ" is meant, within the meaning of the present invention, the compound bearing a diol function, this compound being produced in the composition of additives during exchange of the hydrocarbon-containing groups of the boronic ester compound A2, in particular of the poly(boronic ester) random copolymer, during the transesterification reaction. The polydiol random polymer A1 is not a diol released in situ within the meaning of the present invention. The compounds of formula (VI) are available commercially from the following suppliers: Sigma-Aldrich®, Alfa Aesar® and TCI®.

Characterization of the Novel Compositions of Additives of the Invention:

The compositions of additives of the invention resulting from mixing at least one polydiol random copolymer A1 as defined above, at least one compound A2 as defined above, in particular at least one poly(boronic ester) random copolymer as defined above, and at least one exogenous compound A4 as defined above, have very varied rheological properties as a function of temperature and depending on the proportion of the compounds A1, A2 and A4 used. The polydiol random copolymers A1 and the compounds A2 as defined above have the advantage of being associative and of exchanging chemical bonds thermoreversibly, in particular in a hydrophobic medium, in particular an apolar hydrophobic medium. Under certain conditions, the polydiol random copolymers A1 and the compounds A2 as defined above can be cross-linked. The polydiol random copolymers A1 and the compounds A2 also have the advantage of being exchangeable.

"Associative" means that covalent chemical bonds of the boronic ester type are established between the polydiol random copolymers A1 and the compounds A2 comprising at least two boronic ester functions, in particular with the poly(boronic ester) random copolymer. Depending on the functionality of the polydiols A1 and of the compounds A2 and depending on the composition of the mixtures, formation of the covalent bonds between the polydiols A1 and the compounds A2 may or may not lead to the formation of a three-dimensional polymer network.

By "chemical bond" is meant a covalent chemical bond of the boronic ester type.

By "exchangeable" is meant that the compounds are capable of exchanging chemical bonds with one another without the total number and the nature of the chemical functions being changed. The boronic ester bonds of compounds A2, the boronic ester bonds formed by a transesterification reaction between the boronic esters of compounds A2 and the exogenous compounds A4, as well as the boronic ester bonds formed by association of the polydiol random copolymers A1 and compounds A2, can be exchanged with diol functions borne by the exogenous compounds A4 or borne by the compounds A3 released in situ, in order to form new boronic esters and new diol functions without the total number of boronic ester functions and of diol functions being affected.

Figure 9:
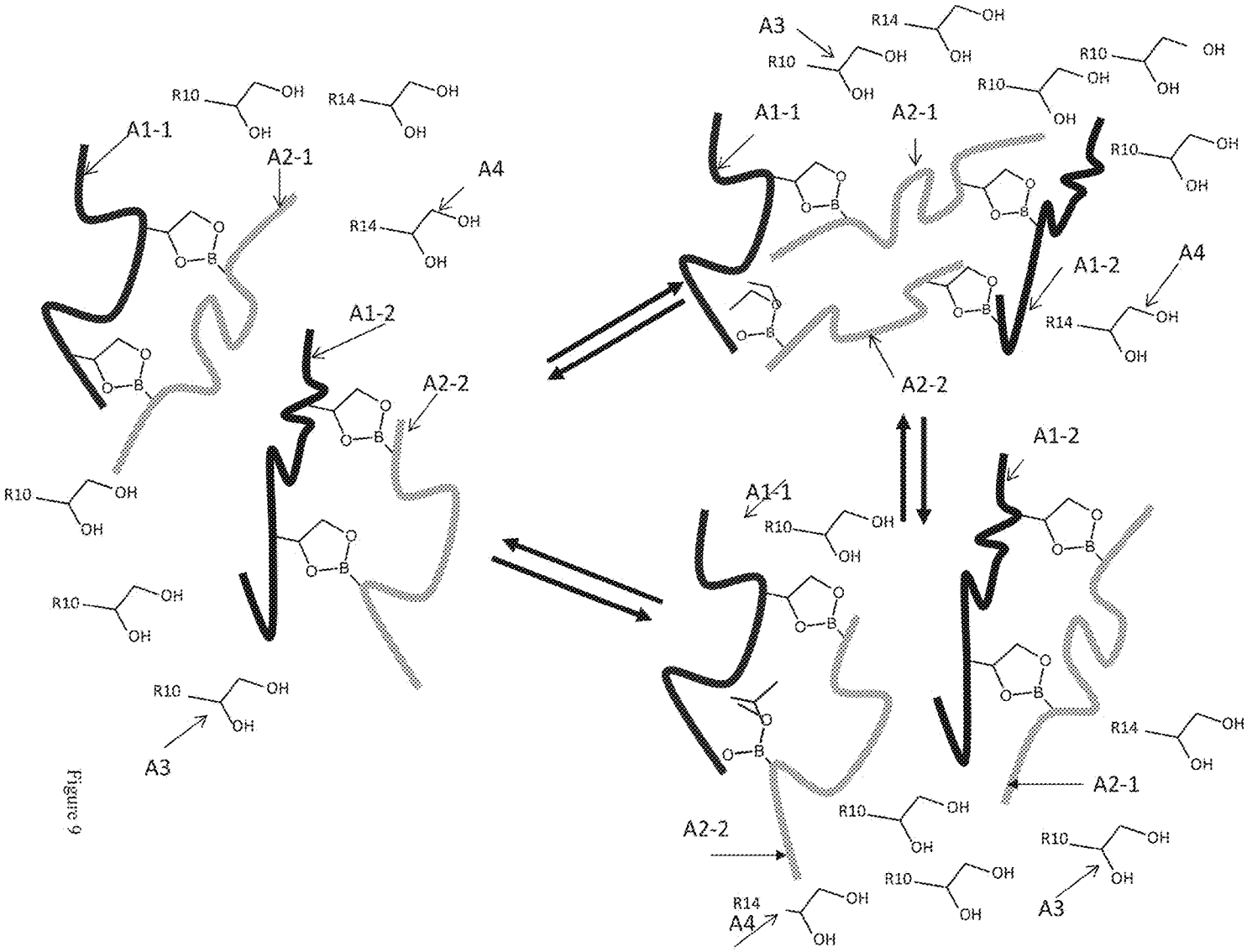
FIG. 9 illustrates schematically the reactions of exchange of boronic ester bonds between two polydiol random polymers (A1-1 and A1-2) and two boronic ester random polymers (A2-1 and A2-2) in the presence of exogenous diol compounds (A4) and of diol compounds released in situ (A3).

In the presence of exogenous compounds A4, the boronic ester bonds of compounds A2 as well as the boronic ester bonds formed by association of the polydiol random copolymers A1 and compounds A2 can also be exchanged in order to form new boronic esters without the total number of boronic ester functions being affected. This other process of exchanges of chemical bonds occurs by a metathesis reaction, via successive exchanges of the boronic ester functions in the presence of diol compounds (compounds A3 released in situ and exogenous compounds A4); this process is illustrated in FIG. 9. The polydiol random copolymer A1-1, which was associated with the polymer A2-1, has exchanged a boronic ester bond with the boronic ester random copolymer A2-2. The polydiol random copolymer A1-2, which was associated with the polymer A2-2, has exchanged a boronic ester bond with the boronic ester random copolymer A2-1; the total number of boronic ester bonds in the composition being unchanged, and equal to 4. The copolymer A1-1 is then associated both with the polymer A2-1 and with the copolymer A2-2. The copolymer A1-2 is then associated both with the copolymer A2-1 and with the copolymer A2-2.

Another process of exchange of chemical bonds is illustrated in FIG. 9, where it can be seen that the polydiol random copolymer A1-1, which was associated with the polymer A2-1, has exchanged two boronic ester bonds with the boronic ester random copolymer A2-2. The polydiol random copolymer A1-2, which was associated with the polymer A2-2, has exchanged two boronic ester bonds with the boronic ester random copolymer A2-1; the total number of boronic ester bonds in the composition being unchanged, and equal to 4. The copolymer A1-1 is then associated with the polymer A2-2. The copolymer A1-2 is then associated with the polymer A2-1. The copolymer A2-1 has been exchanged with the polymer A2-2.

Figure 3:
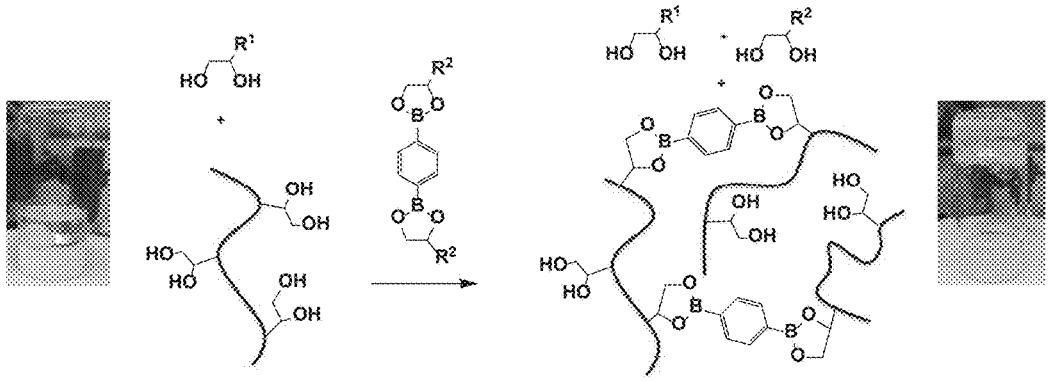
FIG. 3 illustrates and represents schematically the cross-linking of the composition according to the invention in tetrahydrofuran (THF) in the presence of exogenous diol compounds A4.

By "cross-linked" is meant a copolymer in the form of a network obtained by the establishment of bridges between the macromolecular chains of the copolymer. These interlinked chains are for the most part distributed in the three dimensions of space. A cross-linked copolymer forms a three-dimensional network. In practice, formation of a copolymer network is confirmed by a solubility test. It can be confirmed that a copolymer network has been formed by placing the copolymer network in a solvent that is known to dissolve the non-cross-linked copolymers of the same chemical nature. If the copolymer swells instead of dissolving, a person skilled in the art knows that a network has been formed. FIG. 3 illustrates this solubility test.

By "cross-linkable" is meant a copolymer that can be cross-linked.

By "reversibly cross-linked" is meant a cross-linked copolymer the bridges of which are formed by a reversible chemical reaction. The reversible chemical reaction can be shifted in one direction or another, leading to a change in structure of the polymer network. The copolymer can change from an initial non-cross-linked state to a cross-linked state (three-dimensional copolymer network) and from a cross-linked state to an initial non-cross-linked state. In the context of the present invention, the bridges that form between the chains of copolymers are labile. These bridges can form or be exchanged by means of a chemical reaction that is reversible. In the context of the present invention, the reversible chemical reaction is a reaction of transesterification between diol functions of a random copolymer (copolymer A1) and boronic ester functions of a cross-linking agent (compound A2). The bridges formed are bonds of the boronic ester type. These boronic ester bonds are covalent and labile owing to the reversibility of the transesterification reaction.

By "thermoreversibly cross-linked" is meant a copolymer cross-linked by means of a reversible reaction the displacement of which in one direction or another is controlled by the temperature.

Unexpectedly, the applicant observed that the presence of exogenous compounds A4 in this composition of additives makes it possible to control the degree of association and of dissociation between the polydiol random copolymer A1 and the compound A2, in particular the poly(boronic ester) random copolymer. The mechanism of thermoreversible cross-linking of the composition of additives of the invention in the presence of exogenous compounds A4 is presented schematically in FIG. 4.

Figure 4:
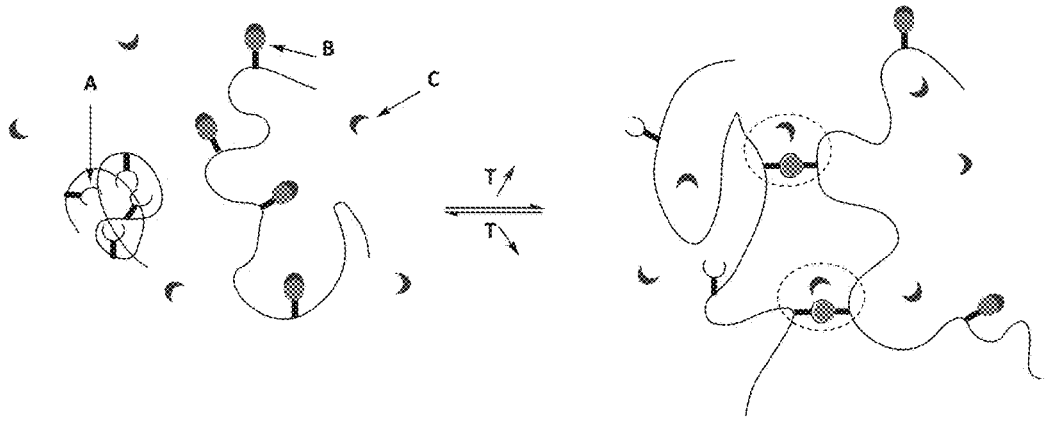
FIG. 4 is a schematic representation of the behaviour of the composition of the invention as a function of the temperature. A random copolymer having diol functions (function A) can associate thermoreversibly with a random copolymer having boronic ester functions (function B) via a reversible reaction of transesterification. There is then formation of a chemical bond of the boronic ester type between the two polymers. The free diol compounds (function C) present in the medium in the form of small organic molecules make it possible to adjust the degree of association between the copolymers bearing the diol functions A and the copolymers bearing the boronic ester functions B.

Unexpectedly, the applicant observed that at low temperature, the polydiol copolymer A1 (represented by the copolymer bearing functions A in FIG. 4) is not or is very slightly cross-linked by the boronic ester compounds A2 (represented by the compound bearing functions B in FIG. 4). The boronic ester compounds A2 establish boronic ester bonds with the exogenous compound A4 (represented by compound C in FIG. 4) by a transesterification reaction.

The polydiol random copolymer A1 is a heat-sensitive copolymer. When the temperature increases, the spatial conformation of the chains of this copolymer is altered; the diol functions are made more accessible to the reactions of association. Thus, when the temperature increases, the diol functions of copolymer A1 react with the boronic ester functions of compound A2 by a reaction of transesterification and release a diol A3 in situ. The polydiol random copolymers A1 and the compounds A2 comprising at least two boronic ester functions then bind together and can undergo exchange. Depending on the functionality of the polydiols A1 and of compounds A2 and depending on the composition of the mixtures, a gel can form in the medium, in particular when the medium is apolar.

When the temperature decreases again, the boronic ester bonds between the polydiol random copolymers A1 and the compounds A2 are broken, and if applicable, the composition loses its gelled character. The compounds A2, in particular the poly(boronic ester) random copolymer, then establish boronic ester bonds by a reaction of transesterification with the exogenous compound A4 or with the diol compound A3 released in situ. By controlling the degree of association of the polydiol random copolymer A1 and of the compound A2, in particular of the poly(boronic ester) random copolymer, the viscosity and the rheological behaviour of this composition are modulated. The exogenous compound A4 makes it possible to modulate the viscosity of this composition as a function of the temperature and according to the desired use.

In a preferred embodiment of the invention, the exogenous compound A4 is of the same chemical nature as the diol compound A3 released in situ by a transesterification reaction between the polydiol random copolymer A1 and the compound A2, in particular the poly(boronic ester) random copolymer. The total quantity of free diols present in said composition is strictly greater than the quantity of diol compounds released in situ. By "free diols" is meant the diol functions that are likely to be able to form a chemical bond of the boronic ester type by a transesterification reaction. By "total quantity of free diols" is meant, within the meaning of the present application, the total number of diol functions likely to be able to form a chemical bond of the boronic ester type by transesterification.

The total quantity of free diols is always equal to the sum of the number of moles of exogenous diol compounds A4 and the number (expressed in mol) of diol functions of the polydiol copolymer A1. In other words, if in the composition of additives there are:

i moles of exogenous diol compounds A4 and j moles of polydiol random copolymers A1, the total quantity of free diols at any instant (therefore whatever the degree of association between the polydiol random copolymer A1 and the compound A2, in particular the poly(boronic ester) random copolymer A2) will be equal to i+j*the average number of diols per chain of random polymer A1 (unit: mol). The quantity of diols released in situ in the context of the reactions of transesterification between A1 and A2 is equal to the number of boronic ester functions linking the copolymers A1 and A2.

A person skilled in the art knows how to select the chemical structure and the quantity of exogenous compounds A4 to add to the composition of additives as a function of the molar percentage of boronic ester functions of compound A2, in particular as a function of the poly (boronic ester) random copolymer, in order to modulate the rheological behaviour of the composition. The quantity of boronic ester bonds (or boronic ester bond) that can be established between the polydiol random copolymers A1 and the compounds A2, in particular the poly(boronic ester) random copolymers, is adjusted by a person skilled in the art by means of appropriate selection of the polydiol random copolymer A1, the compound A2 and the composition of the mixture. Moreover, a person skilled in the art knows how to select the structure of the compound A2, in particular of poly(boronic ester) random copolymer, as a function of the structure of the random copolymer A1. Preferably, when the random copolymer A1 comprises at least one monomer M1 in which y=1, the compound A2 of general formula (III) or the copolymer A2 comprising at least one monomer M3 of formula (IV) will preferably be selected with $w_1$=1, $w_2$=1 and t=1, respectively.

Advantageously, the content of random copolymer A1 in the composition ranges from 0.1 to 99.5% by weight relative to the total weight of the composition of additives, preferably ranges from 0.25 to 80% by weight relative to the total weight of the composition of additives, more preferably from 1 to 50% by weight relative to the total weight of the composition of additives. Advantageously, the content of compound A2, in particular of poly(boronic ester) random copolymer in the composition ranges from 0.1 to 99.5% by weight relative to the total weight of the composition of additives, preferably ranges from 0.25 to 80% by weight relative to the total weight of the composition of additives, more preferably from 0.5 to 50% by weight relative to the total weight of the composition of additives.

In an embodiment, the molar percentage of exogenous compound A4 in the composition of additives ranges from 0.025% to 5000%, preferably ranges from 0.1% to 1000%, more preferably from 0.5 to 500%, even more preferably from 1% to 150% relative to the boronic ester functions of compound A2, in particular of the poly(boronic ester) random copolymer. The molar percentage of exogenous compound A4 relative to the number of boronic ester functions of compound A2 is the ratio of the number of moles of exogenous compound A4 to the number of moles of boronic ester function of compound A2, all multiplied by a hundred. The number of moles of boronic ester function of compound A2 can be determined by a person skilled in the art by proton NMR analysis of compound A2, or by monitoring the conversion to monomers during synthesis of the copolymer A2, when compound A2 is a poly(boronic ester) random copolymer.

Preferably, the weight ratio (A1/A2 ratio) of the polydiol random compound A1 to compound A2, in particular poly (boronic ester) random copolymer, in the composition of additives ranges from 0.005 to 200, preferably from 0.05 to 20, even more preferably from 0.1 to 10, even more preferably from 0.2 to 5. In an embodiment, the composition of the invention can further comprise at least one additive selected from the group formed by the thermoplastics, elastomers, thermoplastic elastomers, thermosetting polymers, pigments, dyes, fillers, plasticizers, fibres, antioxidants, additives for lubricants, compatibility agents, antifoaming agents, dispersants, promoters of adherence and stabilizers.

Process for the Preparation of the Novel Compositions of Additives:

The novel compositions of additives of the invention are prepared by means well known to a person skilled in the art. For example, a person skilled in the art in particular only needs to:

- take a desired quantity of a solution comprising the polydiol random copolymer A1 as defined above;
- take a desired quantity of a solution comprising compound A2 as defined above; in particular a desired quantity of a solution comprising the poly(boronic ester) random copolymer as defined above; and
- take a desired quantity of a solution comprising the exogenous compound A4 as defined above
- mix the three solutions taken, either simultaneously, or sequentially, in order to obtain the composition of the invention.

The order of adding the compounds has no influence on the implementation of the process for the preparation of the composition of additives.

A person skilled in the art also knows how to adjust the different parameters of the composition of the invention in order to obtain either a composition in which the polydiol random copolymer A1 and compound A2, in particular the boronic ester random copolymer, are associated, or a composition in which the polydiol random copolymer A1 and compound A2, in particular the boronic ester random copolymer, are cross-linked, and how to modulate the degree of association or degree of cross-linking thereof for a given temperature of use. For example, a person skilled in the art knows how to adjust in particular:

the molar percentage of monomer M1 bearing diol functions in the polydiol random copolymer A1;

the molar percentage of monomer M3 bearing boronic ester functions in the boronic ester random copolymer A2;

the average length of the side chains of the polydiol random copolymer A1;

the average length of the side chains of the boronic ester random copolymer A2;

the length of the monomer M3 of the boronic ester random copolymer A2;

the length of the boronic diester compound A2;

the number-average degree of polymerization of the polydiol random copolymers A1 and of the boronic ester random copolymers A2;

the percentage by weight of the polydiol random copolymer A1;

the percentage by weight of the boronic diester compound A2;

the percentage by weight of the boronic ester random copolymer A2;

the molar quantity of the exogenous compound A4 relative to the boronic ester functions of compound A2, in particular of the poly(boronic ester) random copolymer, the chemical nature of the exogenous compound A4;

the molar percentage of exogenous compound A4;

etc.

Use of the Novel Compositions:

The compositions of the invention can be used in all media the viscosity of which varies as a function of the temperature. The compositions of the invention make it possible to thicken a fluid and modulate the viscosity as a function of the temperature of use. The composition of additives according to the invention can be used in such varied fields as improved recovery of petroleum, the papermaking industry, paints, food additives, cosmetic or pharmaceutical formulation.

Lubricant Composition:

Another subject of the present invention relates to a lubricant composition resulting from mixing at least:

a lubricating oil a polydiol random copolymer A1 as defined above, a random copolymer A2, as defined above, comprising at least two boronic ester functions and able to associate with said polydiol random copolymer A1 by at least one transesterification reaction, an exogenous compound A4 selected from the 1,2-diols and the 1,3-diols, and in particular as defined above.

The preferences and definitions described for general formulae (I), (I-A), (I-B), (II-A), (II-B) also apply to the polydiol random copolymer A1 used in the lubricant compositions of the invention. The preferences and definitions described for general formulae (IV) and (V) also apply to the boronic ester random copolymer A2 used in the lubricant compositions of the invention.

The lubricant compositions according to the invention have inverse behaviour with respect to a temperature change relative to the behaviour of the base oil and of the rheological additives of the polymer type of the prior art, and have the advantage that this rheological behaviour can be modulated as a function of the temperature of use. Unlike the base oil, which becomes more fluid when the temperature rises, the compositions of the present invention have the advantage of becoming thicker when the temperature rises. Formation of the reversible covalent bonds makes it possible to increase (reversibly) the molecular weight of the polymers and therefore limit the drop in viscosity of the base oil at high temperatures. Moreover, addition of diol compounds makes it possible to control the rate of formation of these reversible bonds. Advantageously, the viscosity of the lubricant composition is thus controlled and is less dependent on the temperature fluctuations. Moreover, for a given temperature of use, it is possible to modulate the viscosity of the lubricant composition and its rheological behaviour by adjusting the quantity of diol compounds added to the lubricant composition.

Lubricating Oil

By "oil" is meant a fat that is liquid at ambient temperature (25° C.) and atmospheric pressure (760 mmHg or 105 Pa). By "lubricating oil" is meant an oil that lessens the friction between two moving parts in order to facilitate the operation of these parts. Lubricating oils can be of natural, mineral or synthetic origin. Lubricating oils of natural origin can be oils of vegetable or animal origin, preferably oils of vegetable origin such as colza oil, sunflower oil, palm oil, copra oil etc.

Lubricating oils of mineral origin are of petroleum origin and are extracted from petroleum cuts obtained from atmospheric and vacuum distillation of crude oil.

Distillation can be followed by refining operations such as solvent extraction, deasphalting, solvent dewaxing, hydrotreating, hydrocracking, hydroisomerization, hydrofinishing etc. As an illustration, the paraffinic mineral base oils such as the oil Bright Stock Solvent (BSS), the naphthenic mineral base oils, the aromatic mineral oils, the hydrofined mineral bases the viscosity index of which is approximately 100, the hydrocracked mineral bases the viscosity index of which is between 120 and 130, and the hydroisomerized mineral bases the viscosity index of which is between 140 and 150 can be mentioned.

Lubricating oils of synthetic origin (or synthetic bases) originate, as their name indicates, from chemical synthesis such as addition of a product to itself or polymerization, or addition of one product to another such as esterification, alkylation, fluorination, etc., of components derived from petrochemistry, organic chemistry, and inorganic chemistry such as: olefins, aromatics, alcohols, acids, halogenated compounds, phosphorus-containing compounds, silicon-containing compounds, etc. As an illustration, there may be mentioned:

synthetic oils based on synthetic hydrocarbons such as the polyalphaolefins (PAO), poly(internal olefins) (PIO), polybutylenes and polyisobutylenes (PIB), dialkylbenenes, alkylated polyphenyls;

synthetic oils based on esters such as the esters of diacids, the esters of neopolyols;

synthetic oils based on polyglycols such as the monoalkylene glycols, polyalkylene glycols and monoethers of polyalkylene glycols;

synthetic oils based on phosphate esters;

synthetic oils based on silicon-containing derivatives such as the silicone oils or the polysiloxanes.

Lubricating oils that can be used in the composition of the invention can be selected from any oils in groups I to V specified in the guidelines of the API (Base Oil Interchangeability Guidelines of the American Petroleum Institute (API)) (or their equivalents according to the ATIEL classification (Association Technique de I'Industrie Européenne des Lubrifiants [Technical Association of the European Lubricants Industry]) as summarized below:

| | Saturated compounds content* | Sulphur content** | Viscosity index (VI)*** |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydroisomerized oils | ≥90% | ≤0.03% | ≥120 |
| Group IV | (PAO) Polyalphaolefins | | |
| Group V | Esters and other bases not included in bases of groups I to IV | | |

*measured according to standard ASTM D2007

**measured according to standards ASTM D2622, ASTM D4294, ASTM D4927 and ASTM D3120

***measured according to standard ASTM D2270

The compositions of the invention can comprise one or more lubricating oils. The lubricating oil or the mixture of lubricating oils is the main ingredient in the lubricant composition. It is then called lubricating base oil. By "main ingredient" is meant that the lubricating oil or the mixture of lubricating oils represents at least 51% by weight relative to the total weight of the composition. Preferably, the lubricating oil or the mixture of lubricating oils represents at least 70% by weight relative to the total weight of the composition.

In an embodiment of the invention, the lubricating oil is selected from the group comprising oils of group I, group II, group III, group IV, group V of the API classification and a mixture thereof. Preferably, the lubricating oil is selected from the group formed by the oils of group III, group IV, group V of the API classification and a mixture thereof. Preferably, the lubricating oil is an oil of group III of the API classification. The lubricating oil has a kinematic viscosity at 100° C., measured according to standard ASTM D445, ranging from 2 to 150 cSt, preferably ranging from 5 to 15 cSt. The lubricating oils can range from grade SAE 15 to grade SAE 250, and preferably from grade SAE 20W to grade SAE 50 (SAE denotes Society of Automotive Engineers).

Functional Additives

In an embodiment, the composition of the invention can further comprise a functional additive selected from the group formed by the detergents, antiwear additives, extreme pressure additives, antioxidants, viscosity index improving polymers, pour point improvers, antifoaming agents, thickeners, anticorrosion additives, dispersants, friction modifiers and mixtures thereof. The functional additive or additives that are added to the composition of the invention are selected as a function of the end use of the lubricant composition. These additives can be introduced in two different ways:

- either each additive is added separately and sequentially to the composition,
- or all of the additives are added to the composition simultaneously, the additives are in this case generally available in the form of a package, called an additive package.

The functional additive or the mixtures of functional additives, when present, represent from 0.1 to 10% by weight relative to the total weight of the composition.

Detergents:

These additives reduce the formation of deposits on the surface of the metal parts by dissolving the by-products of oxidation and combustion. The detergents that can be used in the lubricant compositions according to the present invention are well known to a person skilled in the art. The detergents commonly used in the formulation of lubricant compositions are typically anionic compounds comprising a long lipophilic hydrocarbon-containing chain and a hydrophilic head. The associated cation is typically a cation of an alkali metal or alkaline earth metal. The detergents are preferably selected from the alkali metal or alkaline earth metal salts of carboxylic acids, sulphonates, salicylates, naphthenates, as well as phenolate salts. The alkali metals and alkaline earth metals are preferably calcium, magnesium, sodium or barium. These metal salts can contain the metal in an approximately stoichiometric quantity or in excess (in a quantity greater than the stoichiometric quantity). In the latter case they are called overbased detergents. The metal in excess, giving the detergent its overbased character, is in the form of metal salts that are insoluble in oil, for example carbonate, hydroxide, oxalate, acetate, glutamate, preferably carbonate.

Antiwear Additives and Extreme Pressure Additives:

These additives protect the friction surfaces by forming a protective film that is adsorbed on these surfaces. There is a great variety of antiwear and extreme pressure additives. As an illustration, the phospho-sulphur-containing additives may be mentioned, such as the metal alkylthiophosphates, in particular the zinc alkylthiophosphates, and more specifically the zinc dialkyldithiophosphates or ZnDTP, the amine phosphates, the polysulphides, in particular the sulphur-containing olefins and metal dithiocarbamates.

Antioxidants:

These additives delay the degradation of the composition. Degradation of the composition can be reflected in the formation of deposits, the presence of sludge, or an increase in the viscosity of the composition. The antioxidants act as radical inhibitors or destroyers of hydroperoxides. Antioxidants commonly used include antioxidants of the phenolic or amino type.

Anticorrosion Additives:

These additives cover the surface with a film that prevents access of oxygen to the metal surface. They can sometimes neutralize acids or certain chemicals in order to prevent metal corrosion. As an illustration, for example dimercaptothiadiazole (DMTD), the benzotriazoles, and the phosphites (capture of free sulphur) may be mentioned.

Viscosity Index Improving Polymers:

These additives make it possible to guarantee good low-temperature behaviour and minimum viscosity of the composition at high temperature. As an illustration, for example the polymer esters, the olefin copolymers (OCP), the homopolymers or copolymers of styrene, butadiene or isoprene and the polymethacrylates (PMA) may be mentioned.

Pour Point Improvers:

These additives improve the low-temperature behaviour of the compositions, by slowing down the formation of paraffin crystals. They are for example alkyl polymethacrylates, polyacrylates, polyarylamides, polyalkylphenols, polyalkylnaphthalenes and alkylated polystyrenes.

Antifoaming Additives:

These additives counteract the effect of the detergents. As an illustration, the polymethylsiloxanes and polyacrylates may be mentioned.

Thickeners:

Thickeners are additives used in particular for industrial lubrication and make it possible to formulate lubricants of higher viscosity than the lubricant compositions for engines. As an illustration, the polyisobutylenes having a weight-average molecular weight from 10,000 to 100,000 g/mol may be mentioned.

Dispersants:

These additives ensure that insoluble solid impurities constituted by oxidation by-products that form during use of the composition are kept in suspension and removed. As an illustration, for example succinimides, PIB (polyisobutylene) succinimides and Mannich bases may be mentioned.

Friction Modifiers:

These additives improve the coefficient of friction of the composition. As an illustration, molybdenum dithiocarbamate, amines having at least one hydrocarbon-containing chain of at least 16 carbon atoms, esters of fatty acids and polyols such as the esters of fatty acids and glycerol, in particular glycerol monooleate may be mentioned.

Process for the Preparation of the Lubricant Compositions:

The lubricant compositions of the invention are prepared by means well known to a person skilled in the art. For example, a person skilled in the art in particular just needs to:

- take a desired quantity of a solution comprising the polydiol random copolymer A1 as defined above, in particular that resulting from the copolymerization of at least one monomer of formula (I) with at least one monomer of formula (II-A) and at least one monomer of formula (II-B);
- take a desired quantity of a solution comprising the poly(boronic ester) random copolymer A2 as defined above;
- take a desired quantity of a solution comprising the exogenous compound A4 as defined above mix the three solutions taken, either simultaneously or sequentially, in a lubricating base oil, to obtain the lubricant composition of the invention.

The order of adding the compounds does has no influence on the implementation of the process for the preparation of the lubricant composition.

Properties of the Lubricant Compositions:

The lubricant compositions of the invention result from mixing associative polymers that have the property of increasing the viscosity of the lubricating oil by association, and in particular in certain cases by cross-linking. The lubricant compositions according to the invention have the advantage that said association or cross-linking is thermoreversible and that the degree of association or of cross-linking can be controlled by adding an additional diol compound. A person skilled in the art knows how to adjust the different parameters of the different constituents of the composition in order to obtain a lubricant composition the viscosity of which increases when the temperature increases and in order to modulate its viscosity and its rheological behaviour.

The quantity of boronic ester bonds (or boronic ester bond) that can be established between the polydiol random copolymers A1 and compounds A2, in particular boronic ester random copolymer A2, is adjusted by a person skilled in the art by means of appropriate selection of the polydiol random copolymer A1, in particular that resulting from the copolymerization of at least one monomer of formula (I) with at least one monomer of formula (II-A) and at least one monomer of formula (II-B), of compound A2, in particular the boronic ester random copolymer A2, of the exogenous compound A4, and in particular of the molar percentage of exogenous compound A4. Moreover, a person skilled in the art knows how to select the structure of compound A2, in particular of the boronic ester random copolymer, as a function of the structure of the random copolymer A1, in particular that resulting from the copolymerization of at least one monomer of formula (I) with at least one monomer of formula (II-A) and at least one monomer of formula (II-B). Preferably, when the random copolymer A1, in particular that resulting from the copolymerization of at least one monomer of formula (I) with at least one monomer of formula (II-A) and at least one monomer of formula (II-B), comprises at least one monomer M1 in which y=1, then the compound A2 of general formula (III) or the copolymer A2 comprising at least one monomer M3 of formula (IV) will preferably be selected with $w_1=1$, $w_2=1$ and t=1, respectively.

Moreover, a person skilled in the art knows how to adjust in particular:

- the molar percentage of monomer M1 bearing diol functions in the polydiol random copolymer A1, in particular that resulting from the copolymerization of at least one monomer of formula (I) with at least one monomer of formula (II-A) and at least one monomer of formula (II-B);
- the molar percentage of monomer M3 bearing boronic ester functions in the boronic ester random copolymer A2,
- the average length of the side chains of the polydiol random copolymer A1, in particular that resulting from the copolymerization of at least one monomer of formula (I) with at least one monomer of formula (II-A) and at least one monomer of formula (II-B);
- the average length of the side chains of the boronic ester random copolymer A2,
- the length of monomer M3 of the boronic ester random copolymer A2,
- the average degree of polymerization of the polydiol random copolymers A1, in particular that resulting from the copolymerization of at least one monomer of formula (I) with at least one monomer of formula (II-A) and at least one monomer of formula (II-B), and of the boronic ester random copolymers A2,
- the percentage by weight of the polydiol random copolymer A1, in particular that resulting from the copolymerization of at least one monomer of formula (I) with at least one monomer of formula (II-A) and at least one monomer of formula (II-B),
- the percentage by weight of the boronic ester random copolymer A2,
- the molar percentage of the exogenous compound A4 relative to the boronic ester functions of compound A2, in particular of the poly(boronic ester) random copolymer, etc.

Advantageously, the content of random copolymer A1, in particular that resulting from the copolymerization of at least one monomer of formula (I) with at least one monomer of formula (II-A) and at least one monomer of formula (II-B) in the lubricant composition ranges from 0.25 to 20% by weight relative to the total weight of the lubricant composition, preferably from 1 to 10% by weight relative to the total weight of the lubricant composition. Advantageously, the content of compound A2, in particular the content of boronic ester random copolymer, ranges from 0.25 to 20% by weight relative to the total weight of the lubricant composition, preferably from 0.5 to 10% by weight relative to the total weight of the lubricant composition. Preferably, the weight ratio (A1/A2 ratio) of the polydiol random compound A1, in particular that resulting from the copolymerization of at least one monomer of formula (I) with at least one monomer of formula (II-A) and at least one monomer of formula (II-B), to compound A2, in particular the boronic ester random copolymer, ranges from 0.001 to 100, preferably from 0.05 to 20, even more preferably from 0.1 to 10, more preferably from 0.2 to 5.

In an embodiment, the sum of the weights of the random copolymer A1, in particular that resulting from the copolymerization of at least one monomer of formula (I) with at least one monomer of formula (II-A) and at least one monomer of formula (II-A2), and of compound A2, in particular of the boronic ester random copolymer, ranges from 0.5 to 20% relative to the total weight of the lubricant composition, preferably from 4% to 15% relative to the total weight of the lubricant composition and the weight of lubricating oil ranges from 60% to 99% relative to the total weight of the lubricant composition. In an embodiment, the molar percentage of exogenous compound A4 in the lubricant composition ranges from 0.05% to 5000%, preferably ranges from 0.1% to 1000%, more preferably from 0.5% to 500%, even more preferably from 1% to 150% relative to the boronic ester functions of compound A2, in particular of the poly(boronic ester) random copolymer.

In an embodiment, the lubricant composition of the invention results from mixing:

- 0.5 to 20% by weight at least one polydiol random copolymer A1 as defined above, relative to the total weight of the lubricant composition;
- 0.5 to 20% by weight at least one compound A2 as defined above, in particular of boronic ester random copolymer, relative to the total weight of the lubricant composition; and
- 0.001 to 0.5% by weight at least one exogenous compound A4 as defined above, relative to the total weight of the lubricant composition, and
- 60 to 99% by weight at least one lubricating oil as defined above, relative to the total weight of the lubricant composition.

In another embodiment, the lubricant composition of the invention results from mixing:

- 0.5 to 20% by weight at least one polydiol random copolymer A1 as defined above, relative to the total weight of the lubricant composition;
- 0.5 to 20% by weight at least one compound A2 as defined above, in particular of boronic ester random copolymer, relative to the total weight of the lubricant composition; and
- 0.001 to 0.5% by weight at least one exogenous compound A4 as defined above, relative to the total weight of the lubricant composition, and
- 0.5 to 15% by weight at least one functional additive as defined above, relative to the total weight of the lubricant composition, and
- 60 to 99% by weight at least one lubricating oil as defined above, relative to the total weight of the lubricant composition.

Process for Modulating the Viscosity of a Lubricant Composition

Another subject of the present invention is a process for modulating the viscosity of a lubricant composition, the process comprising at least:

- supplying a lubricant composition resulting from mixing at least one lubricating oil, at least one polydiol random copolymer A1 and at least one random copolymer A2 comprising at least two boronic ester functions and able to associate with said polydiol random copolymer A1 by at least one transesterification reaction,
- adding, to said lubricant composition, at least one exogenous compound A4 selected from the 1,2-diols and the 1,3-diols.

By "modulating the viscosity of a lubricant composition" is meant, within the meaning of the present invention, adapting the viscosity to a given temperature as a function of the use of the lubricant composition. This is obtained by adding an exogenous compound A4 as defined above. This compound makes it possible to control the degree of association and of cross-linking of the two copolymers, polydiol copolymer A1 and poly(boronic ester) copolymer A2.

Preferably, these 1,2-diols or 1,3-diols have the general formula (VI):

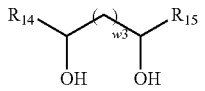

(VI)

with:

- $w_3$ an integer equal to 0 or 1;
- $R_{14}$ and $R_{15}$, identical or different, selected from the group formed by hydrogen and a hydrocarbon-containing group having from 1 to 24 carbon atoms.

In an embodiment, these 1,2-diols or 1,3-diols have the general formula (VI) in which:

- $w_3$ is an integer equal to 0 or 1;
- $R_{14}$ and $R_{15}$ are different, one of the $R_{14}$ or $R_{15}$ groups is H and the other $R_{14}$ or $R_{15}$ group is a hydrocarbon-containing chain, preferably a linear alkyl group having from 1 to 24 carbon atoms, preferably between 4 and 18 carbon atoms, preferably between 6 and 12 carbon atoms.

The definitions and preferences relating to the lubricating oils, to the random copolymers A1, in particular that resulting from the copolymerization of at least one monomer of formula (I) with at least one monomer of formula (II-A) and at least one monomer of formula (II-B), to the boronic ester random copolymers A2 and to the exogenous compounds A4 also apply to the processes for modulating the viscosity of a lubricant composition.

Other Subjects

Another subject of the present invention is the use of the lubricant composition as defined above for lubricating a mechanical component. In the remainder of the description, the percentages are expressed by weight relative to the total weight of the lubricant composition. The compositions of the invention can be used for lubricating the surfaces of the parts conventionally present in an engine, such as the system of pistons, piston rings, and liners.

Thus, another subject of the present invention is a composition for lubricating at least one engine, said composition comprising, in particular consisting essentially of, a composition resulting from mixing:

- 97 to 99.98% by weight a lubricating oil, and
- 0.1 to 3% by weight at least one random copolymer A1 as defined above, in particular that resulting from the copolymerization of at least one monomer of formula (I) with at least one monomer of formula (II-A) and at least one monomer of formula (II-B), at least one boronic ester random copolymer A2 as defined above; and
- 0.001 to 0.1% by weight at least one exogenous compound A4 as defined above; the composition having a kinematic viscosity at 100° C. measured according to standard ASTM D445 ranging from 3.8 to 26.1 cSt; the percentages by weight being expressed relative to the total weight of said composition.

In a composition for lubricating at least one engine as defined above, the random copolymers A1, in particular that resulting from the copolymerization of at least one monomer of formula (I) with at least one monomer of formula (II-A) and at least one monomer of formula (II-B), and the boronic ester random copolymers A2 as defined above can associate and exchange thermoreversibly in the presence of the exogenous compound A4; but they do not form three-dimensional networks. They are not cross-linked. In an embodiment, the composition for lubricating at least one engine further comprises at least one functional additive selected from the group formed by the detergents, antiwear additives, extreme pressure additives, additional antioxidants, anticorrosion additives, viscosity index improving polymers, pour point improvers, antifoaming agents, thickeners, dispersants, friction modifiers and mixtures thereof.

In an embodiment of the invention, the composition for lubricating at least one engine, said composition comprising, in particular consisting essentially of, a composition resulting from mixing:

82 to 99% by weight a lubricating oil, and 0.1 to 3% by weight at least one random copolymer A1 as defined above, in particular that resulting from the copolymerization of at least one monomer of formula (I) with at least one monomer of formula (II-A) and at least one monomer of formula (II-B), at least one boronic ester random copolymer A2 as defined above; and 0.001 to 0.1% by weight at least one exogenous compound A4 as defined above;

0.5 to 15% by weight at least one functional additive selected from the group formed by the detergents, antiwear additives, extreme pressure additives, additional antioxidants, anticorrosion additives, viscosity index improving polymers, pour point improvers, antifoaming agents, thickeners, dispersants, friction modifiers and mixtures thereof;

the composition having a kinematic viscosity at 100° C. measured according to standard ASTM D445 ranging from 3.8 to 26.1 cSt; the percentages by weight being expressed relative to the total weight of said composition. The definitions and preferences relating to the lubricating oils, to the random copolymers A1, in particular that resulting from the copolymerization of at least one monomer of formula (I) with at least one monomer of formula (II-A) and at least one monomer of formula (II-B), to the boronic ester random copolymers A2 and to the exogenous compounds A4 also apply to the compositions for lubricating at least one engine.

Another subject of the present invention is a composition for lubricating at least one transmission, such as manual or automatic gearboxes. Thus, another subject of the present invention is a composition for lubricating at least one transmission, said composition comprising, in particular consisting essentially of, a composition resulting from mixing:

85 to 99.49% by weight a lubricating oil, and 0.5 to 15% by weight at least one random copolymer A1 as defined above, in particular that resulting from the copolymerization of at least one monomer of formula (I) with at least one monomer of formula (II-A) and at least one monomer of formula (II-B), at least one boronic ester random copolymer A2 as defined above; and 0.001 to 0.5% by weight at least one exogenous compound A4 as defined above; the composition having a kinematic viscosity at 100° C. measured according to standard ASTM D445 ranging from 4.1 to 41 cSt, the percentages by weight being expressed relative to the total weight of said composition.

In a composition for lubricating at least one transmission as defined above, the random copolymers A1, in particular that resulting from the copolymerization of at least one monomer of formula (I) with at least one monomer of formula (II-A) and at least one monomer of formula (II-B), and the boronic ester random copolymers A2 as defined above can associate and exchange thermoreversibly in the presence of the exogenous compound A4; but they do not form three-dimensional networks. They are not cross-linked. In an embodiment, the composition for lubricating at least one transmission further comprises at least one functional additive selected from the group formed by the detergents, antiwear additives, extreme pressure additives, additional antioxidants, anticorrosion additives, viscosity index improving polymers, pour point improvers, antifoaming agents, thickeners, dispersants, friction modifiers and mixtures thereof.

In an embodiment of the invention, the composition for lubricating at least one transmission, said composition comprising, in particular consisting essentially of, a composition resulting from mixing:

70 to 99.39% by weight a lubricating oil, and 0.5 to 15% by weight at least one random copolymer A1 as defined above, in particular that resulting from the copolymerization of at least one monomer of formula (I) with at least one monomer of formula (II-A) and at least one monomer of formula (II-B), at least one boronic ester random copolymer A2 as defined above; and 0.001 to 0.5% by weight at least one exogenous compound A4 as defined above;

0.1 to 15% by weight at least one functional additive selected from the group formed by the detergents, antiwear additives, extreme pressure additives, additional antioxidants, anticorrosion additives, viscosity index improving polymers, pour point improvers, antifoaming agents, thickeners, dispersants, friction modifiers and mixtures thereof;

the composition having a kinematic viscosity at 100° C. measured according to standard ASTM D445 ranging from 4.1 to 41 cSt, the percentages by weight being expressed relative to the total weight of said composition. The definitions and preferences relating to the lubricating oils, to the random copolymers A1, in particular that resulting from the copolymerization of at least one monomer of formula (I) with at least one monomer of formula (II-A) and at least one monomer of formula (II-B), to the boronic ester random copolymers A2 and to the exogenous compounds A4, also apply to the compositions for lubricating at least one transmission.

The compositions of the invention can be used for the engines or transmissions of light vehicles, heavy goods vehicles, as well as ships. Another subject of the present invention is a process for lubricating at least one mechanical component, in particular at least one engine or at least one transmission, said process comprising a step in which said mechanical component is brought into contact with at least one lubricant composition as defined above. The definitions and preferences relating to the lubricating oils, to the random copolymers A1, in particular that resulting from the copolymerization of at least one monomer of formula (I) with at least one monomer of formula (II-A) and at least one monomer of formula (II-B), to the boronic ester random copolymers A2 and to the exogenous compounds A4, also apply to the process for lubricating at least one mechanical component.

Another subject of the present invention relates to the use of at least one compound selected from the 1,2-diols or the 1,3-diols for modulating the viscosity of a lubricant composition, said lubricant composition resulting from mixing at least one lubricating oil, at least one polydiol random copolymer A1 and at least one random copolymer A2 comprising at least two boronic ester functions and able to associate with said polydiol random copolymer A1 by at least one transesterification reaction. Preferably, these 1,2-diols or 1,3-diols have the general formula (VI):

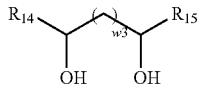

(VI)

with:

$w_3$ an integer equal to 0 or 1;

$R_{14}$ and $R_{15}$, identical or different, selected from the group formed by hydrogen and a hydrocarbon-containing group having from 1 to 24 carbon atoms.

In an embodiment, these 1,2-diols or 1,3-diols have the general formula (VI) in which:

$w_3$ is an integer equal to 0 or 1;

$R_{14}$ and $R_{15}$ are different, one of the groups $R_{14}$ or $R_{15}$ is H and the other $R_{14}$ or $R_{15}$ group is a hydrocarbon-containing chain, preferably a linear alkyl group having from 1 to 24 carbon atoms, preferably between 4 and 18 carbon atoms, preferably between 6 and 12 carbon atoms.

EXAMPLES

The following examples illustrate but do not limit the invention.

1 Synthesis of Random Copolymers A1 Bearing Diol Functions 1.1: Starting from a Monomer Bearing a Diol Function Protected in the Form of Ketal In an embodiment, the random copolymer A1 of the invention is obtained according to the following reaction diagram 10:

Diagram 10

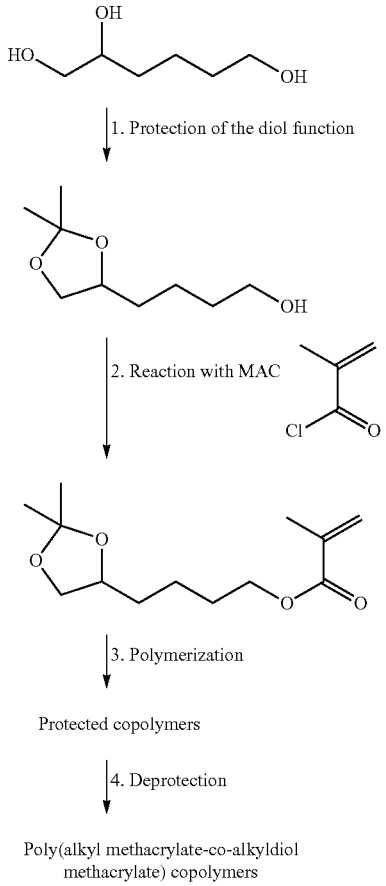

1.1.1 Synthesis of Monomer M1 Bearing a Diol Function Protected in the Form of Ketal Synthesis of a methacrylate monomer bearing a diol function protected in the form of ketal is carried out in two steps (steps 1 and 2 of reaction diagram 10) according to the following protocol:

1st step:

42.1 g (314 mmol) of 1,2,6-hexanetriol (1,2,6-HexTri) is introduced into a 1 L flask. 5.88 g of molecular sieve (4 Å) is added, followed by 570 mL of acetone. 5.01 g (26.3 mmol) of para-toluenesulphonic acid (pTSA) is then added slowly. The reaction medium is stirred for 24 hours at ambient temperature. 4.48 g (53.3 mmol) of $NaHCO_3$ is then added. The reaction mixture is stirred for 3 hours at ambient temperature before being filtered. The filtrate is then concentrated under vacuum in a rotary evaporator until a suspension of white crystals is obtained. 500 mL of water is then added to this suspension. The solution thus obtained is extracted with 4×300 mL of dichloromethane. The organic phases are combined and dried over $MgSO_4$. The solvent is then evaporated completely under vacuum at 25° C. by means of a rotary evaporator.

2nd step:

The product thus obtained is then introduced into a 1 L flask equipped with a dropping funnel. The glassware used had been dried beforehand overnight in an oven thermostated at 100° C. 500 mL of anhydrous dichloromethane is then introduced into the flask, followed by 36.8 g (364 mmol) of triethylamine. A solution of 39.0 g (373 mmol) of methacryloyl chloride (MAC) in 50 mL of anhydrous dichloromethane is introduced into the dropping funnel. The flask is then placed in an ice bath to lower the temperature of the reaction mixture to approximately 0° C. The solution of methacryloyl chloride is then added dropwise, stirring vigorously. Once addition of the methacryloyl chloride has ended, the reaction mixture is stirred for 1 hour at 0° C., then for 23 hours at ambient temperature. The reaction medium is then transferred to a 3 L conical flask and 1 L of dichloromethane is added. The organic phase is then washed successively with 4×300 mL of water, 6×300 mL of an aqueous solution of hydrochloric acid at 0.5 M, 6×300 mL of a saturated aqueous solution of $NaHCO_3$ and again with 4×300 mL of water. The organic phase is dried over $MgSO_4$, filtered and then concentrated under vacuum using a rotary evaporator in order to give 64.9 g (yield of 85.3%) of protected monomer diol in the form of a light yellow liquid with the following characteristics:

$^1$H NMR (400 MHz, $CDCl_3$) δ: 6.02 (singlet, 1H), 5.47 (singlet, 1H), 4.08 (triplet, J=6.8 Hz, 2H), 4.05-3.98 (multiplet, 1H), 3.96 (doublet of doublets, J=6 Hz and J=7.6 Hz, 1H), 3.43 (doublet of doublets, J=7.2 Hz and J=7.2 Hz, 1H), 1.86 (doublet of doublets, J=1.2 Hz and J=1.6 Hz, 3H), 1.69-1.33 (multiplet, 6H), 1.32 (singlet, 3H), 1.27 (singlet, 3H).

1.1.2 Synthesis of Methacrylate Copolymers Bearing Diol Functions

Synthesis of the methacrylate copolymers bearing diol functions is carried out in two steps (steps 3 and 4 of reaction diagram 10):

Copolymerization of two alkyl methacrylate monomers with a methacrylate monomer bearing a diol function protected in the form of ketal;

Deprotection of the copolymer.

More precisely, synthesis of the copolymer is carried out according to the following protocol:

10.5 g (31.0 mmol) of stearyl methacrylate (StMA), 4.76 g (18.7 mmol) of lauryl methacrylate (LMA), 3.07 g (12.7 mmol) of methacrylate bearing a diol function protected in the form of ketal obtained according to the protocol described in paragraph 1.1.1, 68.9 mg (0.253 mmol) of cumyl dithiobenzoate and 19.5 mL of anisole are introduced into a 100-mL Schlenk tube. The reaction mixture is stirred and 8.31 mg (0.0506 mmol) of azobisisobutyronitrile (AIBN) in solution in 85 μL of anisole is introduced into the Schlenk tube. The reaction mixture is then degassed for 30 minutes by bubbling with argon before being heated to 65° C. for a period of 16 hours. The Schlenk tube is placed in an ice bath to stop the polymerization, and then the polymer is isolated by precipitation in methanol, filtration and drying under vacuum at 30° C. overnight.

A copolymer is thus obtained having a number-average molecular weight ($M_n$) of 51,400 g/mol, a polydispersity index (PDI) of 1.20 and a number-average degree of polymerization ($DP_n$) of 184. These values are obtained respectively by size exclusion chromatography using tetrahydrofuran as eluent and polystyrene calibration, and by monitoring the conversion to monomers during copolymerization.

Deprotection of the copolymer is carried out according to the following protocol:

7.02 g of copolymer containing approximately 20% protected diol function obtained beforehand is introduced into a 500-mL conical flask. 180 mL of dioxane is added and the reaction mixture is stirred at 30° C. 3 mL of a 1M aqueous solution of hydrochloric acid and then 2.5 mL of a 35% by weight aqueous solution of hydrochloric acid are added dropwise. The reaction medium becomes slightly opaque and 20 mL of THF is added in order to make the mixture completely homogeneous and transparent. The reaction medium is then stirred at 40° C. for 48 hours. The copolymer is recovered by precipitation from methanol, filtration and drying under vacuum at 30° C. overnight.

A poly(alkyl methacrylate-co-alkyldiol methacrylate) copolymer is obtained containing approximately 20 mol % diol monomer units M1, and having an average length of the pendant alkyl chains of 13.8 carbon atoms.

2. Synthesis of the Poly(Alkyl Methacrylate-co-boronic Ester Monomer) Copolymer 2.1: Synthesis of the Boronic Acid Monomer The boronic ester monomer is synthesized according to the following reaction diagram 11:

Diagram 11

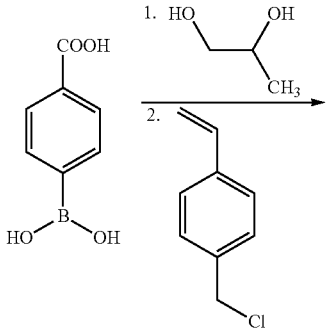

-continued

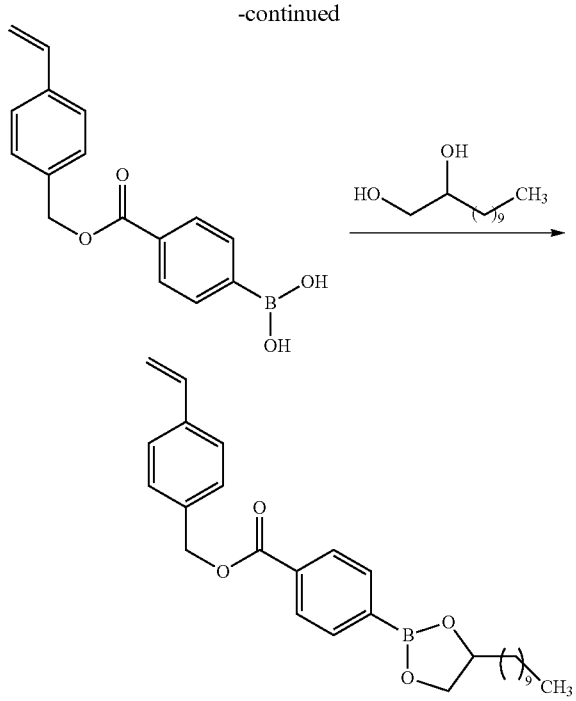

The monomer is obtained according to the two-step protocol:

The first step consists of synthesizing a boronic acid and the second step consists of obtaining a boronic ester monomer.

1st Step:

4-Carboxyphenylboronic acid (CPBA) (5.01 g; 30.2 mmol) is introduced into a 1 L beaker, followed by 350 mL of acetone, and the reaction medium is stirred. 7.90 mL (439 mmol) of water is added dropwise until the 4-carboxyphenylboronic acid has dissolved completely. The reaction medium is then transparent and homogeneous. 1,2-Propanediol (2.78 g; 36.6 mmol) is then added slowly, followed by an excess of magnesium sulphate in order to trap the water initially introduced as well as the water released by the condensation between CPBA and 1,2-propanediol. The reaction medium is stirred for 1 hour at 25° C. before being filtered. The solvent is then removed from the filtrate by means of a rotary evaporator. The product thus obtained and 85 mL of DMSO are introduced into a 250-mL flask. The reaction medium is stirred, then after complete homogenization of the reaction medium, 8.33 g (60.3 mmol) of $K_2CO_3$ is added. 4-(Chloromethyl)styrene (3.34 g; 21.9 mmol) is then slowly introduced into the flask. The reaction medium is then stirred at 50° C. for 16 hours. The reaction medium is transferred to a 2 L conical flask, and then 900 mL of water is added. The aqueous phase is extracted with 8×150 mL of ethyl acetate. The organic phases are combined, and then extracted with 3×250 mL of water. The organic phase is dried over $MgSO_4$ and filtered. The solvent is removed from the filtrate by means of a rotary evaporator to give the boronic acid monomer (5.70 g; yield of 92.2%) in the form of a white powder, with the following characteristics:

$^1$H NMR (400 MHz, $CDCl_3$) δ: 7.98 (doublet, J=5.6 Hz, 4H), 7.49 (doublet, J=4 Hz, 4H), 6.77 (doublet of doublets, J=10.8 Hz and J=17.6 Hz, 1H), 5.83 (doublet of doublets, J=1.2 Hz and J=17.6 Hz, 1H), 5.36 (singlet, 2H), 5.24 (doublet of doublets, J=1.2 Hz and J=11.2 Hz, 1H).

2nd Step:

The boronic acid monomer (5.7 g; 20.2 mmol) obtained in the first step and 500 mL of acetone are introduced into a 1 L conical flask. The reaction medium is stirred and 2.6 mL (144 mmol) of water is added dropwise until the boronic acid monomer has dissolved completely. The reaction medium is then transparent and homogeneous. A solution of 1,2-dodecanediol (5.32 g; 26.3 mmol) in 50 mL of acetone is slowly added to the reaction medium, followed by an excess of magnesium sulphate in order to trap the water initially introduced as well as the water released by the condensation between the boronic acid monomer and the 1,2-dodecanediol. After stirring for 3 hours at ambient temperature, the reaction medium is filtered. The solvent is then removed from the filtrate by means of a rotary evaporator in order to give 10.2 g of a mixture of boronic ester monomer and 1,2-dodecanediol in the form of a light yellow solid.

The characteristics are as follows:

$^1$H NMR (400 MHz, $CDCl_3$): Boronic ester monomer: δ: 8.06 (doublet, J=8 Hz, 2H), 7.89 (doublet, J=8 Hz, 2H), 7.51 (doublet, J=4 Hz, 4H), 6.78 (doublet of doublets, J=8 Hz and J=16 Hz, 1H), 5.84 (doublet of doublets, J=1.2 Hz and J=17.6 Hz, 1H), 5.38 (singlet, 2H), 5.26 (doublet of doublets, J=1.2 Hz and J=11.2 Hz, 1H), 4.69-4.60 (multiplet, 1H), 4.49 (doublet of doublets, J=8 Hz and J=9.2 Hz, 1H), 3.99 (doublet of doublets, J=7.2 Hz and J=9.2 Hz, 1H), 1.78-1.34 (multiplet, 18H), 0.87 (triplet, J=6.4 Hz, 3H); 1,2-dodecanediol: δ: 3.61-3.30 (multiplet, approximately 1.62H), 1.78-1.34 (multiplet, approximately 9.72H), 0.87 (triplet, J=6.4 Hz, approximately 1.62H)

2.2 Synthesis of the A2 Poly(Alkyl Methacrylate-Co-Boronic Ester Monomer) Random Copolymer The random copolymer A2 is obtained according to the following protocol:

2.09 g of a mixture of boronic ester monomer and 1,2-dodecanediol prepared beforehand (containing 3.78 mmol of boronic ester monomer), 98.3 mg (0.361 mmol) of cumyl dithiobenzoate, 22.1 g (86.9 mmol) of lauryl methacrylate (LMA) and 26.5 mL of anisole are introduced into a 100-mL Schlenk tube. The reaction medium is stirred and 11.9 mg (0.0722 mmol) of azobisisobutyronitrile (AIBN) in solution in 120 μL of anisole is added to the Schlenk tube. The reaction medium is then degassed for 30 minutes by bubbling with argon before being heated to 65° C. for a period of 16 hours. The Schlenk tube is placed in an ice bath to stop the polymerization, and then the polymer is isolated by precipitation in anhydrous acetone, filtration and vacuum drying at 30° C. overnight.

A copolymer is thus obtained having the following structure:

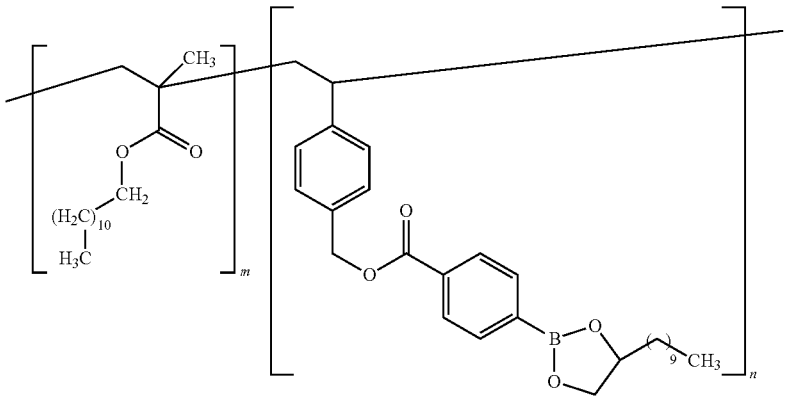

with m=0.96 and n=0.04.

The boronic ester copolymer obtained has a number-average molecular weight ($M_n$) equal to 37,200 g/mol, a polydispersity index (PDI) equal to 1.24 and a number-average degree of polymerization ($DP_n$) equal to 166. These values are obtained by size exclusion chromatography using tetrahydrofuran as eluent and polystyrene calibration and by monitoring the conversion to monomers during copolymerization, respectively. Analysis of the final copolymer by proton NMR gives a composition of 4 mol % boronic ester monomer and 96% lauryl methacrylate.

3. Rheological Investigations 3.1 Ingredients for Formulating Compositions a to H Lubricating base oil:

The lubricating base oil used in the test compositions is an oil of group III of the API classification, marketed by SK under the name Yubase 4. It has the following characteristics:

- Kinematic viscosity at 40° C. measured according to standard ASTM D445: 19.57 cSt;
- Kinematic viscosity measured at 100° C. according to standard ASTM D445: 4.23 cSt;
- Viscosity index measured according to standard ASTM D2270: 122;
- Noack volatility in percentage by weight, measured according to standard DIN 51581: 14.5;
- Flash point in degrees Celsius measured according to standard ASTM D92: 230° C.; Pour point in degrees Celsius measured according to standard ASTM D97: −15° C.

Polydiol random copolymer A-1:

This copolymer comprises 20 mol % monomers having diol functions. The average length of side chain is 13.8 carbon atoms. Its number-average molecular weight is 51,400 g/mol. Its polydispersity index is 1.20. Its number-average degree of polymerization (DPn) is 184. The number-average molecular weight and the polydispersity index are measured by size exclusion chromatography using polystyrene calibration. This copolymer is obtained by implementing the protocol described in paragraph 1 above.

Boronic ester random copolymer A-2:

This copolymer comprises 4 mol % monomers having boronic ester functions. The average length of side chains is greater than 12 carbon atoms. Its number-average molecular weight is 37,200 g/mol. Its polydispersity index is 1.24. Its number-average degree of polymerization (DPn) is 166. The number-average molecular weight and the polydispersity index are measured by size exclusion chromatography using polystyrene calibration. This copolymer is obtained by implementing the protocol described in paragraph 2 above.

Compound A-4:

1,2-Docecanediol is obtained from the supplier TCI®.

3.2 Formulation of Compositions for Studying the Viscosity

Composition A (comparative) is obtained as follows:

It contains a solution with 4.2% by weight a polymethacrylate polymer in a lubricating base oil of group III of the API classification. The polymer has a number-average molecular weight (Mn) equal to 106,000 g/mol, a polydispersity index (PDI) equal to 3.06, a number-average degree of polymerization of 466 and the average length of the pendant chains is 14 carbon atoms. This polymethacrylate is used as a viscosity index improver.

4.95 g of a formulation having a concentration by weight of 42% of this polymethacrylate in a group III base oil and 44.6 g of group III base oil are introduced into a bottle. The solution thus obtained is stirred at 90° C. until the polymethacrylate has dissolved completely. A solution with 4.2% by weight this polymethacrylate is obtained. This composition is used as a reference for studying the viscosity. It represents the rheological behaviour of the commercial lubricant compositions.

Composition B (comparative) is obtained as follows:

6.75 g of polydiol copolymer A-1 and 60.7 g of a group III base oil are introduced into a bottle. The solution thus obtained is stirred at 90° C. until the polydiol A-1 has dissolved completely. A solution with 10% by weight polydiol copolymer A-1 is obtained.

Composition C (comparative) is obtained as follows:

6 g of the solution with 10% by weight polydiol copolymer A-1 in a group III base oil prepared beforehand is introduced into a bottle. 0.596 g of poly(boronic ester) A-2 and 9.01 g of group III base oil are added to this solution. The solution thus obtained is stirred at 90° C. until the poly(boronic ester) A-2 has dissolved completely. A solution with 3.8% by weight polydiol copolymer A-1 and 3.8% by weight poly(boronic ester) copolymer A-2 is obtained.

Composition D (according to the invention) is obtained as follows:

7.95 g of composition C prepared beforehand is introduced into a bottle. 19.2 mg of a solution with 5% by weight 1,2-dodecanediol (compound A-4) in a group III base oil is added to this solution. The solution thus obtained is stirred at 90° C. for two hours. A solution with 3.8% by weight polydiol copolymer A-1, 3.8% by weight poly(boronic ester) copolymer A-2 and 10 mol % free 1,2-dodecanediol (compound A-4) relative to the boronic ester functions of the poly(boronic ester) copolymer A-2 is obtained.

Composition E (according to the invention) is obtained as follows:

4.04 g of composition C prepared beforehand is introduced into a bottle. 97.6 mg of a solution with 5% by weight 1,2-dodecanediol (compound A-4) in a group III base oil is added to this solution. The solution thus obtained is stirred at 90° C. for two hours. A solution with 3.8% by weight polydiol copolymer A-1, 3.8% by weight poly(boronic ester) copolymer A-2 and 100 mol % free 1,2-dodecanediol (compound A-4) relative to the boronic ester functions of the poly(boronic ester) copolymer A-2 is obtained.

Composition F (comparative) is obtained as follows:

0.80 g of poly(boronic ester) copolymer A-2 and 7.21 g of a group III base oil are introduced into a bottle. The solution thus obtained is stirred at 90° C. until the polymer has dissolved completely. A solution with 10% by weight poly (boronic ester) copolymer A-2 is obtained.

3.2 Formulation of Compositions for Studying their Elastic Modulus and Viscous Modulus Composition G (comparative) is obtained as follows:

0.416 g of polydiol copolymer A1 and 0.46 g of poly (boronic ester) copolymer A-2, and then 8.01 g of group III base oil are introduced into a bottle. The solution thus obtained is stirred at 90° C. until the polymers have dissolved completely. A solution with 4.7% by weight polydiol copolymer A-1 and 5.2% by weight poly(boronic ester) copolymer A-2 is obtained.

Composition H (according to the invention) is obtained as follows:

2.00 g of solution G is introduced into a bottle. 40.5 mg of the solution with 5% by weight 1,2-dodecanediol (compound A-4) is added. The solution thus obtained is stirred at 90° C. for 2 hours. A solution with 4.7% by weight polydiol copolymer A-1, 5.2% by weight poly(boronic ester) copolymer A-2 and 66 mol % 1,2-dodecanediol relative to the boronic ester functions of the poly(boronic ester) copolymer A-2 is obtained.

3.3 Equipment and Protocols for Measurement of Viscosity

The rheological studies were carried out using a Couette MCR 501 controlled stress rheometer from the company Anton Paar. In the case of the formulations of polymers that do not form gels in a group III base oil over the temperature range of the study (compositions A to F), the rheology measurements were carried out using a cylindrical geometry of reference DG 26.7. The viscosity was measured as a function of the shearing rate for a temperature range from 10° C. to 110° C. For each temperature, the viscosity of the system was measured as a function of the shearing rate from 0.01 to 1000 $s^{-1}$. The measurements of viscosity as a function of the shearing rate at T=10° C., 20° C., 30° C., 50° C., 70° C., 90° C. and 110° C. were carried out (from 10° C. to 110° C.) followed by new measurements at 10° C. and/or 20° C. in order to assess the reversibility of the systems. An average viscosity was then calculated for each temperature using the measurement points located on the same level.

The relative viscosity calculated according to the following formula $$\left(\eta_{relative} = \frac{\eta_{solution}}{\eta_{base\ oil}}\right)$$

was selected to represent the variation of the viscosity of the system as a function of temperature, as this quantity directly reflects the compensation to the natural loss of viscosity of a group III base oil of the polymer systems studied.

In the case of the formulations of polymers that form gels in a group III base oil over the temperature range of the investigation (compositions G and H), the rheology measurements were carried out using a cone-and-plate geometry of reference CP50 (diameter=50 mm, angle 20). The elastic modulus and the loss modulus were measured as a function of temperature for a temperature range from 10° C. to 110° C.

The heating (and cooling) rate was fixed at 0.003° C./s, and the angular frequency was selected at 1 rad/s with strain of 1%.

3.4 Results Obtained in Rheology

Figure 5:
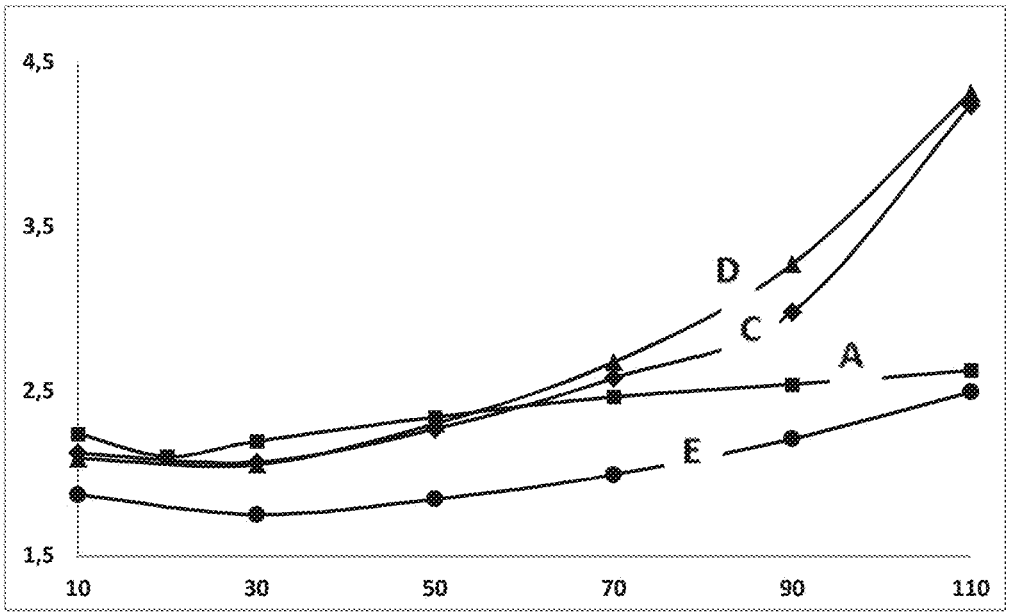
FIG. 5 shows the variation of the relative viscosity (no unit, y-axis) as a function of the temperature (° C., x-axis) of compositions A, C, D and E.
Figure 6:
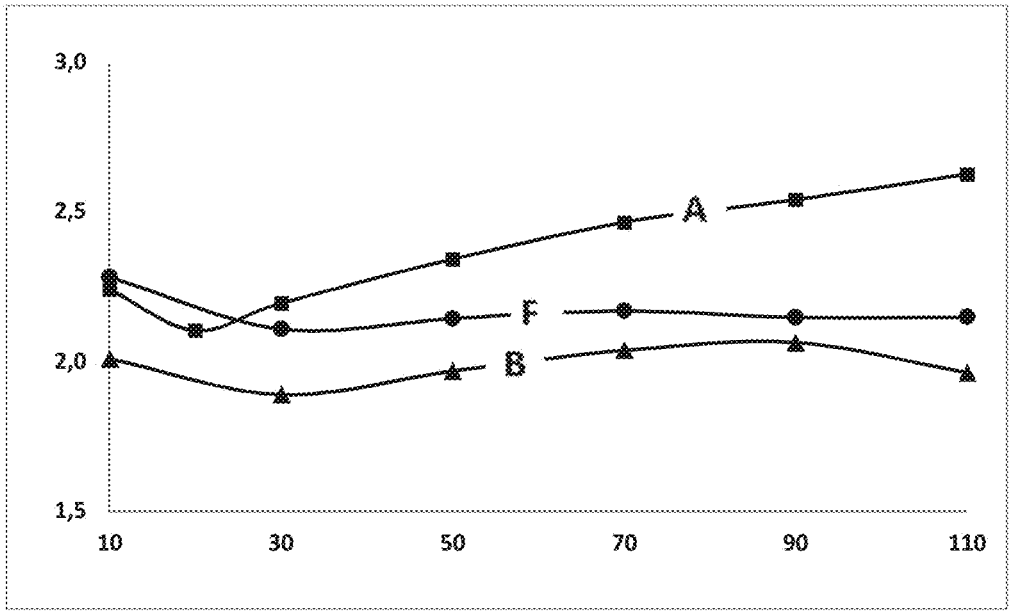
FIG. 6 shows the variation of the relative viscosity (no unit, y-axis) as a function of the temperature (° C., x-axis) of compositions A, B and F.

The viscosity of compositions A to F was studied for a temperature range from 10° C. to 110° C. The relative viscosity of these compositions is illustrated in FIGS. 5 and 6. The polydiol random copolymer A-1, alone in composition B, does not provide compensation of the natural loss of viscosity of the group III base oil. The same applies to the poly(boronic ester) copolymer A-2 when this copolymer is used alone in composition F.

When the polydiol random copolymer A-1 and the poly (boronic ester) copolymer A-2 are present together in the same lubricant composition (composition C), compensation of the natural loss of viscosity of the group III base oil is observed that is greater than that which results from adding the polymethacylate polymer to the group III base oil (composition A). When the composition (composition C) further comprises 10 mol % free 1,2-dodecanediol (compound A-4) relative to the boronic ester functions of the poly(boronic ester) copolymer A-2 (composition D), a slight reduction in low-temperature viscosity (temperatures below 45° C.) is observed, whereas the compensation of the loss of high-temperature viscosity is slightly greater than that of composition C which comprises the polydiol random copolymer A-1 and the poly(boronic ester) copolymer A-2.

When the composition (composition C) further comprises 100 mol % free 1,2-dodecanediol (compound A-4) relative to the boronic ester functions of the poly(boronic ester) copolymer A-2 (composition E), a reduction in low-temperature viscosity (temperatures below 45° C.) is observed. At higher temperatures, the composition resulting from mixing the polydiol random copolymer A-1, the poly(boronic ester) copolymer A-2 and 1,2-dodecanediol (compound A-4) compensates the loss of viscosity of the group III base oil comparably to that obtained with the polymethacrylate polymer in the group III base oil (composition A). Thus, in the presence of 1,2-dodecanediol, the low-temperature properties of composition E were improved relative to those of composition C. Moreover, composition E still retains the property of compensating the loss of viscosity of the group III base oil for high temperatures. 1,2-Dodecanediol therefore allows the viscosity of a lubricant composition resulting from mixing at least one polydiol random copolymer A-1 and at least one poly(boronic ester) random copolymer A-2 to be modified as a function of the temperature, by controlling the degree of association of the chains of these two copolymers.

Figure 7:
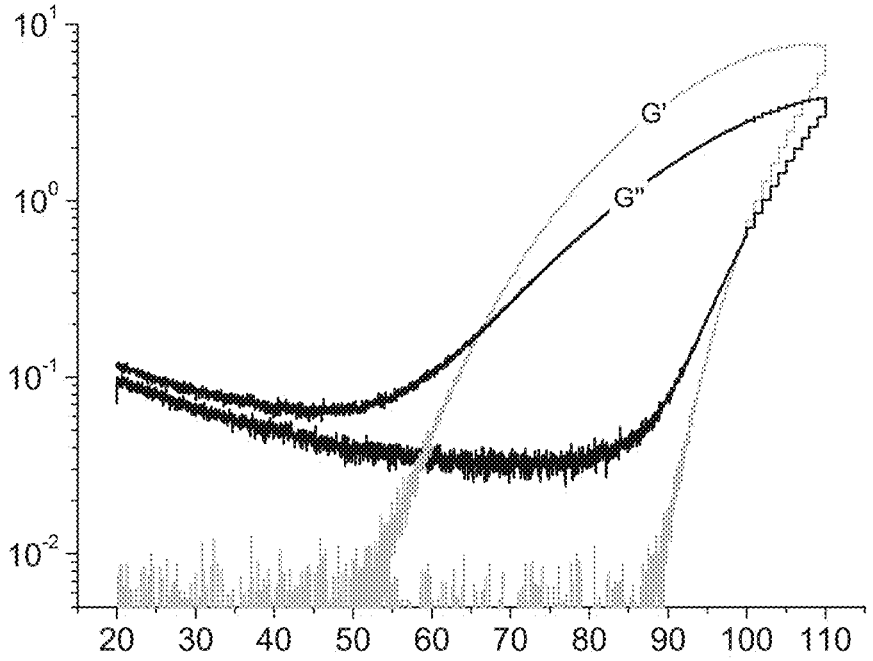
FIG. 7 shows the variation of the elastic modulus (G') and of the viscous modulus (G") (Pa, y-axis) as a function of the temperature (° C., x-axis) of composition G.
Figure 8:
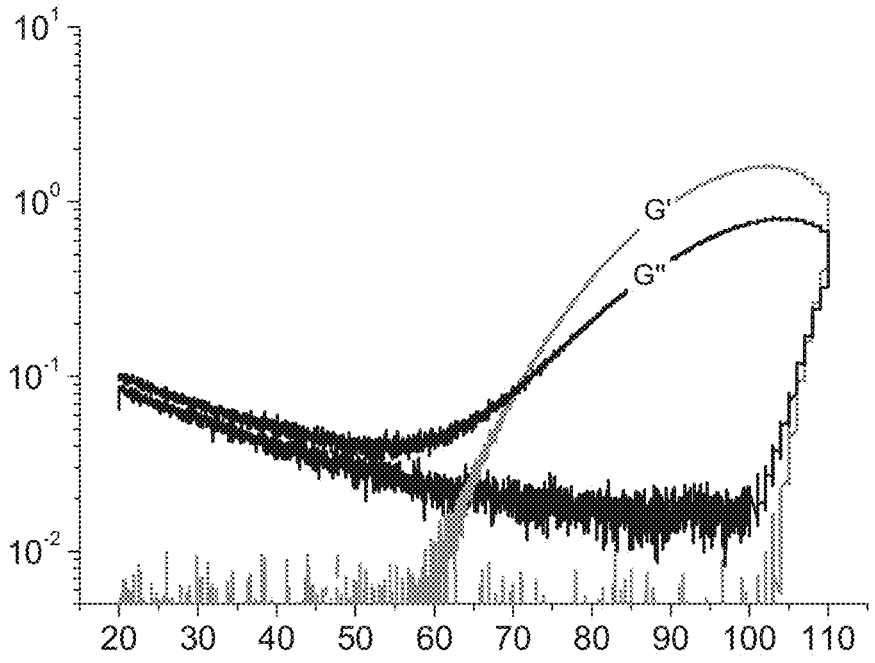
FIG. 8 shows the variation of the elastic modulus (G') and of the viscous modulus (G") (Pa, y-axis) as a function of the temperature (° C., x-axis) of composition H.

The rheological behaviour of compositions G and H was studied as a function of temperature (hysteresis curve in FIGS. 7 and 8). These two compositions result from mixing the polydiol random copolymer A-1 and the poly(boronic ester) random copolymer A-2 in a group III base oil. Composition H further comprises 1,2-dodecanediol (compound A-4). The intersection of curves G' and G" shows the change of state of the compositions, i.e. transition from a liquid state to a gelled state when the temperature rises and transition from a gelled state to a liquid state when the temperature falls.

For composition G (FIG. 7), it can be seen that the temperature at which the composition passes from a liquid state to a gelled state occurs between 95° C. and 100° C. At this temperature there is association and exchange of the chains of copolymers A-1 and A-2, forming a three-dimensional cross-linked network. When the temperature is reduced, a new change of state is observed for a temperature comprised between 65° C. and 70° C. The composition passes from a gelled state to a liquid state where there is no longer association between the chains of the copolymers.

For composition H (FIG. 8), a shift of the value of the temperature at which the state of the composition changes is observed. In fact, composition H undergoes gelation at a temperature between 105 and 110° C. and passes to a liquid state at a temperature between 70° C. and 75° C. 1,2-Dodecanediol (compound A-4) makes it possible to modulate the rheological behaviour of composition H.

The invention claimed is:

1. A composition of additives resulting from mixing at least:

a polydiol random copolymer A1;

a random copolymer A2 comprising at least two boronic ester functions and able to associate with the polydiol random copolymer A1 by at least one transesterification reaction; and an exogenous compound A4 selected from 1,2-diols and 1,3-diols, wherein a molar percentage of exogenous compound A4 relative to the boronic ester functions of the random copolymer A2 ranges from 0.025 to 5000, and a weight ratio of the polydiol random copolymer A1 to the random copolymer A2 (A1/A2 ratio) ranges from 0.005 to 200.

2. The composition of additives according to claim 1, wherein the random copolymer A1 results from the copolymerization:

(a) of at least one first monomer M1 of a general formula (I):

(I)

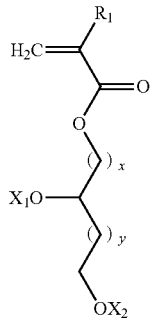

in which:

$R_1$ is selected from a group formed by —H, —$CH_3$, and —$CH_2$—$CH_3$;

x is an integer ranging from 1 to 18;

y is an integer equal to 0 or 1;

$X_1$ and $X_2$, identical or different, are selected from a group formed by hydrogen, tetrahydropyranyl, methyloxymethyl, tert-butyl, benzyl, trimethylsilyl and t-butyl dimethylsilyl;

or $X_1$ and $X_2$ form, with oxygen atoms, a bridge of the following formula

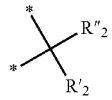

in which:

the stars (*) represent bonds to the oxygen atoms, $R'_2$ and $R''_2$, identical or different, are selected from a group formed by hydrogen and a $C_1$-$C_{11}$ alkyl, preferably methyl;

or $X_1$ and $X_2$ form, with the oxygen atoms, a boronic ester of the following formula:

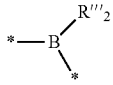

in which:

the stars (*) represent bonds to the oxygen atoms, $R'''_2$ is selected from a group formed by a $C_6$-$C_{18}$ aryl, a $C_7$-$C_{18}$ aralkyl and $C_2$-$C_{18}$ alkyl;

(b) with at least one second monomer M2 of general formula (II):

(II)

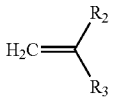

in which:

$R_2$ is selected from a group formed by —H, —$CH_3$ and —$CH_2$—$CH_3$, and $R_3$ is selected from a group formed by a $C_6$-$C_{18}$ aryl, a $C_6$-$C_{18}$ aryl substituted with an $R'_3$ group, —C(O)—O—$R'_3$; —O—$R'_3$, —S—$R'_3$ and —C(O)—N(H)—$R'_3$ with $R'_3$ a $C_1$-$C_{30}$ alkyl group.

3. The composition of additives according to claim 2, wherein the random copolymer A1 results from the copolymerization of at least one monomer M1 with at least two monomers M2 having different groups $R_3$.

4. The composition of additives according to claim 3, wherein one of the monomers M2 of the random copolymer A1 has a general formula (II-A):

(II-A)

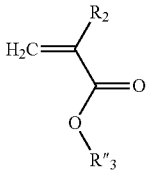

in which:

$R_2$ is selected from a group formed by —H, —$CH_3$ and —$CH_2$—$CH_3$, $R''_3$ is a $C_1$-$C_{14}$ alkyl group, and the other monomer M2 of the random copolymer A1 has a general formula (II-B):

(II-B)

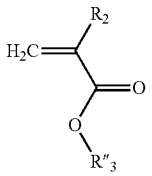

in which:

$R_2$ is selected from a group formed by —H, —$CH_3$ and —$CH_2$—$CH_3$, and $R'''_3$ is a $C_{15}$-$C_{30}$ alkyl group.

5. The composition of additives according to claim 2, wherein side chains of the random copolymer A1 have an average length ranging from 8 to 20 carbon atoms.

6. The composition of additives according to claim 2, wherein the random copolymer A1 has a molar percentage of monomer M1 of formula (I) in the copolymer ranging from 1 to 30%.

7. The composition of additives according to claim 1, wherein the random copolymer A2 results from copolymerization (a) of at least one monomer M3 of formula (IV):

(IV)

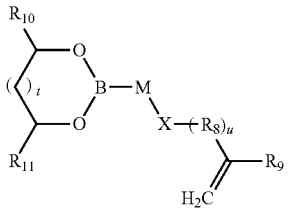

in which:

t is an integer equal to 0 or 1;

u is an integer equal to 0 or 1;

M and $R_8$ are divalent binding groups, identical or different, selected from a group formed by a $C_6$-$C_{18}$ aryl, a $C_7$-$C_{24}$ aralkyl and a $C_2$-$C_{24}$ alkyl;

X is a function selected from a group formed by —O—C(O)—, —C(O)—O—, —C(O)—N(H)—, —N(H)—C(O)—, —S—, —N(H)—, —N($R'_4$)— and —O— with $R'_4$ a hydrocarbon-containing chain comprising from 1 to 15 carbon atoms;

$R_9$ is selected from a group formed by —H, —$CH_3$ and —$CH_2$—$CH_3$;

$R_{10}$ and $R_{11}$, identical or different, are selected from a group formed by hydrogen and a hydrocarbon-containing group having from 1 to 24 carbon atoms;

(b) with at least one second monomer M4 of general formula (V):

(V)

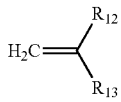

in which:

$R_{12}$ is selected from a group formed by —H, —$CH_3$ and —$CH_2$—$CH_3$; and $R_{13}$ is selected from a group formed by a $C_6$-$C_{18}$ aryl, a $C_6$-$C_{18}$ aryl substituted with an $R'_{13}$ group, —C(O)—O—$R'_{13}$; —O—$R'_{13}$, —S—$R'_{13}$ and —C(O)—N(H)—$R'_{13}$ with $R'_{13}$ a $C_1$-$C_{25}$ alkyl group.

8. The composition of additives according to claim 7, wherein the chain formed by linking together of the $R_{10}$, M, X and $(R_8)_u$ groups with u equal to 0 or 1 of the monomer of the general formula (IV) of the random copolymer A2 has a total number of carbon atoms ranging from 8 to 38.

9. The composition of additives according to claim 7, wherein the side chains of the random copolymer A2 have an average length greater than or equal to 8 carbon atoms.

10. The composition of additives according to claim 7, wherein the random copolymer A2 has a molar percentage of monomer of the formula (IV) in the copolymer ranging from 0.25 to 20%.

11. The composition of additives according to claim 1, in which the exogenous compound A4 has a general formula (VI):

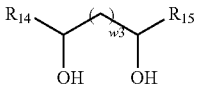

(VI)

with:

$w_3$ an integer equal to 0 or 1; and $R_{14}$ and $R_{15}$, identical or different, selected from a group formed by hydrogen and a hydrocarbon-containing group having from 1 to 24 carbon atoms.

12. The composition of additives according to claim 11, in which the substituents $R_{10}$, $R_{11}$ and the value of the index (t) of the monomer of formula (IV) of the random copolymer A2 are identical respectively to the substituents $R_{14}$, $R_{15}$ and to the value of the index $w_3$ of the exogenous compound A4 of the formula (VI).

13. The composition of additives according to claim 11, in which at least one of the substituents $R_{10}$, $R_{11}$ or the value of the index (t) of the monomer of the formula (IV) of the random copolymer A2 is different respectively from the substituents $R_{14}$, $R_{15}$ or the value of the index $w_3$ of the exogenous compound A4 of formula (VI).

14. A lubricant composition resulting from mixing at least:

a lubricating oil chosen from oils of group I, group II, group III, group IV, and group V of the API classification and a mixture thereof; and a composition of additives comprising:

a polydiol random copolymer A1;

a random copolymer A2 comprising at least two boronic ester functions and able to associate with the polydiol random copolymer A1 by at least one transesterification reaction; and an exogenous compound A4 selected from 1,2-diols and 1,3-diols.

15. The lubricant composition according to claim 14, in which a weight ratio of the random copolymer A1 to the random copolymer A2 (A1/A2 ratio) ranges from 0.001 to 100.

16. The lubricant composition according to claim 15, wherein a molar percentage of exogenous compound A4 relative to the boronic ester functions of the random copolymer A2 ranges from 0.05 to 5000%.

17. The lubricant composition according to claim 16, resulting from additionally mixing a functional additive selected from a group formed by the detergents, antiwear additives, extreme pressure additives, additional antioxidants, viscosity index improving polymers, pour point improvers, antifoaming agents, anticorrosion additives, thickeners, dispersants, friction modifiers and mixtures thereof.

18. A process for modulating viscosity of a lubricant composition, the process comprising:

(a) supplying a lubricant composition resulting from mixing at least one lubricating oil, at least one polydiol random copolymer A1 and at least one random copolymer A2 comprising at least two boronic ester functions and able to associate with the polydiol random copolymer A1 by at least one transesterification reaction; and (b) adding, to the lubricant composition, at least one exogenous compound A4 selected from 1,2-diols and 1,3-diols.

19. A method of using at least one compound selected from the 1,2-diols or the 1,3-diols, the method comprising modulating a viscosity of a lubricant composition, the lubricant composition resulting from mixing at least one lubricating oil, at least one polydiol random copolymer A1 and at least one random copolymer A2 comprising at least two boronic ester functions and associating with the polydiol random copolymer A1 by at least one transesterification reaction.

* * * * *